US010252483B2

(12) United States Patent
Kamph et al.

(10) Patent No.: US 10,252,483 B2
(45) Date of Patent: Apr. 9, 2019

(54) BOX-MAKING APPARATUS AND METHOD

(71) Applicant: CRAYOLA, LLC, Easton, PA (US)

(72) Inventors: Carl J. Kamph, Bethlehem, PA (US); Timothy J. Watson, Easton, PA (US); Thomas R. Rau, Easton, PA (US); Steven Menow, Easton, PA (US); Michael Charles, Easton, PA (US)

(73) Assignee: CRAYOLA, LLC, Easton, PA (US)

( * ) Notice: Subject to any disclaimer, the term of this patent is extended or adjusted under 35 U.S.C. 154(b) by 354 days.

(21) Appl. No.: 15/167,228

(22) Filed: May 27, 2016

(65) Prior Publication Data

US 2016/0347020 A1 Dec. 1, 2016

Related U.S. Application Data

(60) Provisional application No. 62/167,973, filed on May 29, 2015.

(51) Int. Cl.

| | |
|---|---|
| ***B31D 5/04*** | (2017.01) |
| ***B31B 50/25*** | (2017.01) |
| ***B31B 50/44*** | (2017.01) |
| ***B31B 50/99*** | (2017.01) |
| ***B31B 3/46*** | (2006.01) |

(52) U.S. Cl.

CPC ..... *B31B 50/99* (2017.08); *B31D 5/04* (2013.01); *B31B 50/252* (2017.08); *B31B 50/44* (2017.08); *B31B 2247/00* (2013.01)

(58) Field of Classification Search

CPC ..... B31B 50/44; B31B 50/46; B31B 50/70; B31B 2247/00; B31B 50/99; B31B 50/252; B31D 5/04

USPC ..... 493/143, 145, 151, 160, 162, 228, 231, 493/240

See application file for complete search history.

(56) References Cited

U.S. PATENT DOCUMENTS

| | | | | |
|---|---|---|---|---|
| 3,673,928 A * | 7/1972 | Striplin | B31B 50/00 | 493/114 |
| 6,616,586 B2 * | 9/2003 | Dai | B27N 3/08 | 264/320 |
| 2012/0241510 A1 * | 9/2012 | Clougherty | B65D 3/04 | 229/120 |

* cited by examiner

*Primary Examiner* — Hemant Desai
*Assistant Examiner* — Veronica Martin
(74) *Attorney, Agent, or Firm* — Shook, Hardy & Bacon LLP

(57) ABSTRACT

Embodiments of the invention are directed to an apparatus and method for creating folded multi-dimensional shapes from pliable substrates. An apparatus having a handle connected to one or more plungers that are configured to move along a longitudinal axis is used to form folds in a flat substrate by pressing dies attached to the plungers into a die area to shape the flat substrate. The handle is depressed multiple times to achieve the desired number of folds in the substrate. The apparatus may include one or more plunger adjustment mechanisms to switch use of the one or more plungers to create different sets of folds in the substrate with each depression.

15 Claims, 31 Drawing Sheets

BOX-MAKING APPARATUS AND METHOD

CROSS-REFERENCE TO RELATED APPLICATION

This application is a nonprovisional of and claims priority to U.S. Provisional Application No. 62/167,973, entitled "BOX MAKING APPARATUS AND METHOD," filed on May 29, 2015, the entire contents of which is hereby incorporated by reference.

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

In brief and at a high level, this disclosure describes, among other things an apparatus and method for creating boxes from pliable, flat substrates. Embodiments of the apparatus include a base having a die area and a depression, a housing coupled to the base, a scoring plunger having a scoring die, an internal box plunger having a box die, and a handle. In embodiments of the apparatus, the handle, the scoring plunger, and the internal box plunger are all configured to slide along a longitudinal axis of the apparatus. Specifically, depression of the scoring plunger and the internal box plunger, via depression of the handle, causes the scoring die and the box die, respectively, to contact a substrate blank to fold the substrate blank into a box. The scoring die and the box die may create different folds on the substrate blank, and, as such, the scoring plunger and the internal box plunger may be used in different folding cycles to achieve different sets of folds.

In accordance with embodiments of the invention, a substrate blank is inserted into the depression of the base of the apparatus. The handle is depressed a first time to move the scoring plunger and the internal box plunger downward into the die area, thereby folding the substrate blank for a first time. The handle is then released and returned to its original position. The handle is then depressed a second time to move the internal box plunger downward into a depression within the die area, folding the substrate blank for a second time. During this second folding cycle, the scoring plunger remains elevated while the internal box plunger is moved downward. In one aspect, the scoring plunger may remain elevated and/or refrain from depressing against the substrate blank based on one or more features of the housing, plunger, and/or base. As such, the scoring plunger may be automatically retained in an upright position away from the substrate blank, while in further embodiments, the scoring plunger may be manually rotated into a retained position with respect to the internal box plunger. After the second folding cycle, the handle is then released, returning to its initial position. In some aspects, the handle may then be depressed a third time, moving the internal box plunger down into the depression again, creating a third set of folds to complete the box. Although described herein as including a first cycle of a combined scoring and box plunger, and a second and third cycle of the box plunger alone, in additional embodiments, fewer or greater number of cycles of manipulating the handle and/or plunger devices may be included for forming one or more folds of the box.

DESCRIPTION OF THE DRAWINGS

Illustrative embodiments of the invention are described in detail below with reference to the attached drawing figures, and wherein.

DETAILED DESCRIPTION

Figure 1:
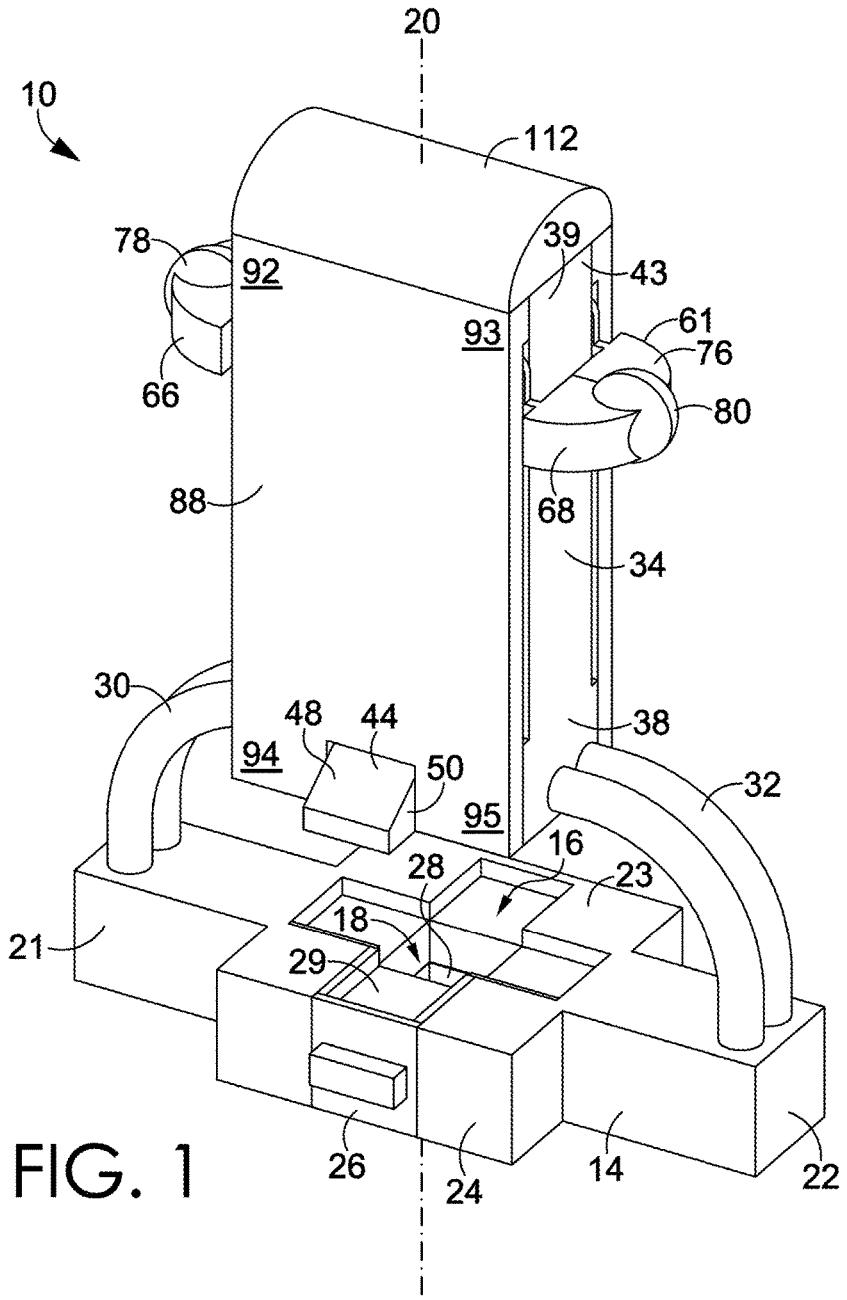
FIG. 1 is a perspective view of a box making apparatus, in accordance with an embodiment of the invention.

The subject matter of embodiments of the invention is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

In one aspect, an apparatus for forming pliable substrates into boxes comprises: a base having a die area and a depression within the die area; a housing coupled to the base, the housing having an internal channel extending through a longitudinal axis of the apparatus; a scoring plunger having a top portion configured to slide longitudinally within the internal channel of the housing and a bottom portion comprising a scoring die, wherein the scoring plunger comprises a scoring channel extending through the longitudinal axis of the apparatus; an internal box plunger having a top portion configured to slide longitudinally within the scoring channel of the scoring plunger and a bottom portion comprising a box die; and a handle configured to travel along the longitudinal axis of the apparatus and to engage at least one of the scoring plunger and the internal box plunger. In accordance with embodiments, depressing the handle a first time moves the scoring plunger and the internal box plunger downward relative to the base into a first depressed position, the first depressed position comprising engaging at least the scoring die with the die area to create a first set of folds in a substrate blank positioned within the die area. In further embodiments, depressing the handle a second time moves the internal box plunger downward relative to the base into a second depressed position while the scoring plunger remains stationary, wherein the second depressed position comprises engaging the box die of the internal box plunger with the depression of the die area to create a second set of folds in the substrate blank.

In another aspect, an apparatus for forming pliable substrates into boxes comprises: a base having a die area and a depression within the die area; a housing coupled to the base, the housing having an internal channel extending through a longitudinal axis of the apparatus; a scoring plunger having a top portion configured to slide longitudinally within the internal channel of the housing and a bottom portion comprising a scoring die, wherein the scoring plunger comprises a scoring channel extending through the longitudinal axis of the apparatus; an internal box plunger having a top portion configured to slide longitudinally within the scoring channel of the scoring plunger and a bottom portion comprising a box die; a handle configured to travel along the longitudinal axis of the apparatus and to engage at least one of the scoring plunger and the internal box plunger; and a plunger adjustment mechanism. In accordance with embodiments, the plunger adjustment mechanism, during a first folding cycle, causes a first depression of the handle to move the scoring plunger and the internal box plunger downward relative to the base and, during a second folding cycle, causes a second depression of the handle to move the internal box plunger downward relative to the base while the scoring plunger remains stationary. The apparatus may be configured to at least partially fold a substrate blank into a box with a first set of folds created by the scoring die in the first folding cycle and a second set of folds created by the internal box die in the second folding cycle.

In a further aspect, an apparatus for forming flat substrates into multi-dimensional shapes comprises: a base having a die area and a depression within the die area; a housing coupled to the base, the housing having an internal channel extending through a longitudinal axis of the apparatus; a scoring plunger having a top portion configured to slide longitudinally into the internal channel of the housing and a bottom portion that comprises a scoring die, wherein the scoring plunger comprises a scoring channel extending through the longitudinal axis of the apparatus; an internal box plunger having a top portion configured to slide longitudinally into the scoring channel of the scoring plunger and a bottom portion comprising a box die; a handle having a first guide slot and a second guide slot, wherein the handle engages at least a portion of the housing such that the handle travels along the longitudinal axis of the apparatus, and wherein the first guide slot and the second guide slot are perpendicular to the longitudinal axis of the apparatus and are oriented parallel to one another; a front outer housing plate attached to the housing and having a first cam path; a back outer housing plate attached to the housing and having a second cam path; and a plunger rod having a first end that extends through the first guide slot and engages the first cam path of the front outer housing plate, and a second end that extends through the second guide slot and engages the second cam path of the back outer housing plate, wherein the plunger rod travels back and forth along a path perpendicular to the first guide slot and the second guide slot.

In one embodiment of the invention, an apparatus for forming pliable substrates into boxes comprises: a base having a die area and a depression; a release drawer configured to be removably inserted into the depression; an internal housing connected to the base with a left base support and a right base support, the internal housing having an internal channel extending through a longitudinal axis of the apparatus; a scoring plunger having a top portion configured to slide longitudinally into the internal channel of the internal housing and a bottom portion comprised of a scoring die, wherein the scoring plunger includes a scoring channel extending through the longitudinal axis of the apparatus; an internal box plunger having a top portion configured to slide longitudinally into the scoring channel of the scoring plunger and a bottom portion comprised of a box die; a handle having a left grip, a right grip, a first guide slot, and a second guide slot, wherein the handle engages at least a portion of the internal housing such that the handle travels along the longitudinal axis of the apparatus, and wherein the first guide slot and the second guide slot are perpendicular to the longitudinal axis of the apparatus and are oriented parallel to one another; a front outer housing plate attached to the interior housing having a first cam path; a back outer housing plate attached to the interior housing having a second cam path; a plunger rod having a first end that extends through the first guide slot of the handle element and engages the first cam path of the front outer housing plate, and a second end that extends through the second guide slot of the handle element and engages the second cam path of the back outer housing plate; and at least one spring configured to apply tension to the scoring plunger and/or the internal box plunger.

In another embodiment of the invention, a method of forming a box from pliable substrates comprises: inserting a substrate blank into a box forming apparatus, wherein the substrate blank comprises a central portion positioned between a first outer portion and a second outer portion, wherein the central portion has central portion extensions extending in opposite directions that are longer than outer portions extensions extending from the first outer portion and the second outer portion, wherein the outer portion extensions are parallel to the central portion extensions; depressing the handle a first time to move the scoring plunger downward relative to the base, wherein the first depressed position comprises engaging the scoring die of the scoring plunger with the die area to create a first set of folds in the substrate blank; releasing the handle and allowing it to return to its original position with tension from the springs; depressing the handle a second time from the original position to move the internal box plunger downward relative to the base, wherein the second depressed position comprises engaging the box die of the internal box plunger with the well of the release drawer to create a second set of folds in the substrate blank; releasing the handle and allowing it to return to its original position with tension from the springs; depressing the handle a third time from the original position to a third depressed position to move the internal box plunger downward relative to the base, wherein the third depressed position comprises engaging the box die of the internal box plunger with the well of the release drawer to create a third set of folds to complete the box; releasing the handle and allowing it to return to its original position with tension from the springs; and removing the release drawer and the completed box.

In a further embodiment, an apparatus for forming flat substrates into multi-dimensional shapes comprises: a base, comprising a die area for receiving a substrate blank and a depression, said die area partially extending into a left portion, a right portion, and a back portion of the base, and wherein a depression extends through a front portion of the base; a release drawer having a well configured to receive at least a portion of a multi-dimensional shape, wherein the release drawer is configured to be slideably received into the depression of the base; a left base support attached to the left portion of the base; a right base support attached to the right portion of the base; an internal housing having an internal channel extending through a longitudinal axis of the internal housing, a lower left portion of the internal housing attached to the left base support and a lower right portion of the internal housing attached to the right base support; a scoring plunger for creating folds in the substrate blank, wherein a top portion of the scoring plunger is configured to slide longitudinally into the internal channel of the internal housing and includes a scoring channel extending through the longitudinal axis of the scoring plunger, and wherein a bottom portion of the scoring plunger comprises a scoring die configured to be received in the die area of the base; an internal box plunger for further folding the substrate blank, wherein a top portion of the internal box plunger is configured to slide longitudinally into the scoring channel of the scoring plunger and wherein a bottom portion of the internal box plunger comprises a box die configured to be received in the well of the release drawer when the release drawer is inserted into the depression of the base; a front handle element having a plunger rod guide slot, wherein the front handle element slidably engages a front portion of the internal housing; a back handle element having a plunger rod guide slot, wherein the back handle element slidably engages a back portion of the internal housing, and a left portion of the back handle element is attached to a left portion of the front handle element forming a left grip, and a right portion of the back handle element is attached to a right portion of the front handle element forming a right grip; a plunger rod extending perpendicular to the longitudinal axis of the internal housing such that a first end of the plunger rod extends through the plunger rod guide slot of the front handle element and a second end of the plunger rod extends through the plunger rod guide slot of the back handle element; a front outer housing plate having a first cam path, wherein an upper left portion of the front outer housing plate is attached to an upper left portion of the internal housing, an upper right portion of the front outer housing plate is attached to an upper right portion of the internal housing, a lower left portion of the front outer housing plate is attached to the lower left portion of the internal housing, a lower right portion of the front outer housing plate is attached to the lower right portion of the internal housing such that a space is provided for the handle elements to move freely along the longitudinal axis of the apparatus, and wherein the first end of the plunger rod engages the first cam path; a back outer housing plate having a second cam path, wherein an upper left portion of the back outer housing plate is attached to an upper left portion of the internal housing, an upper right portion of the back outer housing plate is attached to an upper right portion of the internal housing, a lower left portion of the back outer housing plate is attached to the lower left portion of the internal housing, a lower right portion of the back outer housing plate is attached to the lower right portion of the internal housing such that a space is provided for the handle elements to move freely along the longitudinal axis of the apparatus, and wherein the second end of the plunger rod engages the second cam path; at least one spring configured to apply tension to the scoring plunger; and/or the internal box plunger.

Figure 2:
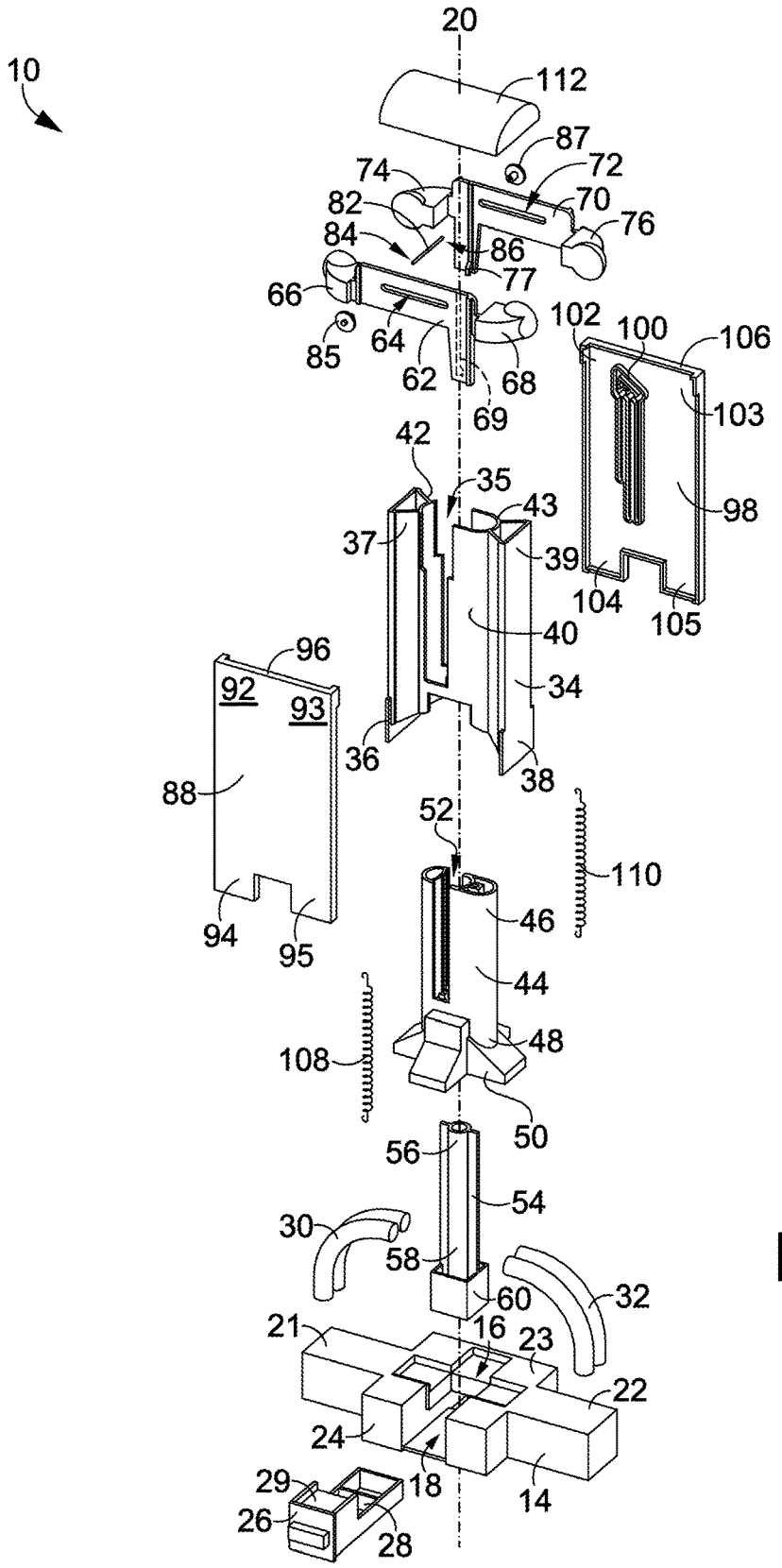
FIG. 2 is an exploded view of the apparatus of FIG. 1, in accordance with an embodiment of the invention.

With reference initially to FIGS. 1 and 2, embodiments of the box making apparatus 10 includes a base 14 with a die area 16 and a depression 18. In one embodiment, the base 14 is oriented perpendicular to a longitudinal axis 20 of the apparatus 10. The die area 16 may extend into at least a portion of a left portion 21, a right portion 22, a front portion 24, and a back portion 23 of the base 14 at right angles and is configured to receive a substrate blank. In one embodiment, the depression 18 in the center of the die area 16, as centered within the base 14 and between the left portion 21, right portion 22, back portion 23, and front portion 24 of the base 14, is deeper than the die area 16 such that a thickness of the depression 18 is greater than the thickness of the die area 16. In further aspects, the depression 18 extends all the way through the front portion 24 of the base 14 based on coupling to at least a portion of the release drawer 26.

In further aspects, the depression 18 removably receives a release drawer 26. In embodiments, the release drawer 26 includes a well 28 configured to receive a multi-dimensional shape as it is being formed. When the release drawer 26 is positioned within the depression 18, the well 28 may be centered along the longitudinal axis 20 of the apparatus and/or at the center of the die area 16. Further, the well 28 may be rectangular to receive a box being formed. In some embodiments, a shelf 29 of the release drawer 26 forms a portion of the die area 16 at the front portion 24 of the base 14 when the release drawer 26 is positioned in the depression 18, such that the die area 16 forms a cross shape that includes a depression in the left portion 21, right portion 22, and back portion 23 of the base, along with a depression corresponding to the depressed surface of the shelf 29 within the front portion 24.

In another embodiment of the invention, the base 14 is coupled to a housing for one or more plungers. In the aspect shown, the base 14 is coupled to an internal housing 34 by a left base support 30 and a right base support 32. The internal housing 34 may be aligned such that an internal channel 35 of the internal housing 34 is aligned with the longitudinal axis 20 of the apparatus 10. The left base support 30 may be attached to the left portion 21 of the base 14 and a lower left portion 36 of the internal housing 34. Further, according to one embodiment, the right base support 32 may be attached to the right portion 22 of the base 14 and a lower right portion 38 of the internal housing 34.

In some aspects, the internal channel 35 of the internal housing 34 is configured to receive a scoring plunger 44. A top portion 46 of the scoring plunger 44 may be slideably received into the internal channel 35 of the internal housing 34. Further, the bottom portion 48 of the scoring plunger 44 may include a scoring die 50 configured to engage at least a portion of the die area 16 of the base 14 in order to create folds in a substrate blank. In one embodiment of the invention, the scoring die 50 is shaped like a cross to correspond with the shape of the die area 16. Accordingly, embodiments of the scoring die 50 may include first, second, third, and fourth portions having a perimeter that mates to at least a portion of an internal wall of the die area 16. In further aspects, the scoring die 50 of the scoring plunger 44 may engage a recessed portion of the die area 16 within the base 14 to form at least one scored depression and/or fold on the substrate blank 200 (shown in FIG. 3).

The scoring plunger 44 may further include a scoring channel 52 aligned with the longitudinal axis 20 of the apparatus 10. The scoring channel 52 of the scoring plunger 44 is configured to slideably receive a top portion 56 of an internal box plunger 54, in one aspect. Further, a bottom portion 58 of the internal box plunger 54 may include a box die 60 configured to be received within the well 28 of the release drawer 26 during the folding process to create folds in a substrate blank. In one aspect, the box die 60 may be rectangular in shape to correspond with a rectangular shaped well 28.

According to embodiments of the invention, a handle 61 engages at least a portion of the internal housing 34 such that the handle 61 travels along the longitudinal axis 20 of the apparatus 10. In some aspects, the handle 61 comprises a front handle element 62 that engages a front portion 40 of the internal housing 34 in a slideable manner. The front handle element 62 includes a first plunger rod guide slot 64 oriented perpendicular to the longitudinal axis 20 of the apparatus. In further embodiments, the front handle element 62 includes a spring attachment point 69, configured to couple to a first end of the spring 108. Additionally, a second end of the spring 108 may be coupled to the apparatus 10 at a remote portion from the spring attachment point 69, such as an underside portion of the top piece 112.

In embodiments, the handle 61 further comprises a back handle element 70 that engages a back portion 42 of the internal housing 34 in a slideable manner. The back handle element 70 may include a second plunger rod guide slot 72 oriented perpendicular to the longitudinal axis 20 of the apparatus and parallel to the first plunger rod guide slot 64 of the front handle element 62. The left portion 74 of the back handle element 70 is attached to the left portion 66 of the front handle element 62, forming a left grip 78, in one embodiment. Further, the right portion 76 of the back handle element 70 may be attached to the right portion 68 of the front handle element 62, forming a right grip 80. In further embodiments, the back handle element 70 includes a spring attachment point 77, configured to couple to a first end of the spring 110. Additionally, a second end of the spring 110 may be coupled to the apparatus 10 at a remote portion from the spring attachment point 77, such as an underside portion of the top piece 112.

In one embodiment, a plunger rod 82 extends perpendicular to the longitudinal axis 20 of the apparatus 10 such that a first end 84 of the plunger rod 82 extends through the first plunger rod guide slot 64 of the front handle element 62, and a second end 86 extends through the second plunger rod guide slot 72 of the back handle element 70. The plunger rod 82 may be generally cylindrical in shape and is configured to travel back and forth within the first and second plunger rod guide slots of the handle 61.

The upper left portion 92 of a front outer housing plate 88 is attached to the upper left portion 37 of the internal housing 34, the upper right portion 93 of the front outer housing plate 88 is attached to the upper right portion 39 of the internal housing 34, the lower left portion 94 of the front outer housing plate is attached to the lower left portion 36 of the internal housing 34, and the lower right portion 95 of the front outer housing plate 88 is attached to the lower right portion 38 of the internal housing 34, according to embodiments. In one embodiment, this arrangement allows space for the handle 61 to move freely along the longitudinal axis of the apparatus in a sliding manner. In additional aspects, the front outer housing plate 88 comprises a first cam path 90 (shown in FIG. 4A) facing towards the internal housing 34 of the apparatus 10. The first end 84 of the plunger rod 82 engages the first cam path 90 at a right angle, in one embodiment of the invention. A first guide cap 85 may be attached at the first end 84 of the plunger rod 82 such that the first guide cap 85 engages the first cam path 90.

In further embodiments of the invention, the upper left portion 102 of a back outer housing plate 98 is attached to the upper left portion 37 of the internal housing 34, the upper right portion 103 of the back outer housing plate 98 is attached to the upper right portion 39 of the internal housing 34, the lower left portion 104 of the back outer housing plate 98 is attached to the lower left portion 36 of the internal housing 34, and the lower right portion 105 of the front outer housing plate 98 is attached to the lower right portion 38 of the internal housing 34. In some aspects, this arrangement allows space for the handle 61 to move freely along the longitudinal axis of the apparatus in a sliding manner. Further, the back outer housing plate 98 comprises a second cam path 100 facing towards the internal housing 34 of the apparatus 10. Additionally, the second end 86 of the plunger rod 82 engages the second cam path 100 at a right angle. In some aspects, a second guide cap 87 may be attached at the second end 86 of the plunger rod 82 such that the second guide cap 87 engages the second cam path 100. In some aspects, the first cam path 90 and the second cam path 100 are mirror images of each other and are oriented parallel to one another. The cam paths are described in further detail below.

The apparatus 10 may also include a top piece 112 oriented perpendicular to the longitudinal axis 20 of the apparatus 10. The top piece 112 is attached to a top portion 43 of the internal housing 34, a top edge 96 of the front outer housing plate 88, and a top edge 106 of the back outer housing plate 98 according to some aspects.

In embodiments of the invention, springs 108 and 110 are configured to adjust a position of one or more features of the apparatus 10, such as a position of a plunger feature configured to shape one or more portions of a substrate template. In additional embodiments, a spring or other biasing force may be engaged with one or more portions of the device to provide an amount of force necessary to return one or more upper features of the apparatus to a starting position relative to a compressed position. In further aspects, a spring 108 and 110 may be used to balance an amount of force applied to the apparatus and/or to gradually administer an applied force based on resistance from the springs 108 and 110. In some aspects, a spring or other biasing force may include an elastic attachment, a motorized attachment, a pulley attachment, a ratcheted attachment, a wind-up attachment, a gear-driven attachment, or any other combination of devices configured to provide a desired amount of resistance for downward-traveling portions of the apparatus 10, and a desired amount of force for upward-traveling portions of the apparatus 10. As such, although discussed herein with reference to springs 108 and 110, in some embodiments, another mechanism or combination of mechanisms, either manual or automated, may be used for movement in multiple directions and between multiple positions of the apparatus 10 during formation of cube and/or box structure.

Figure 3:
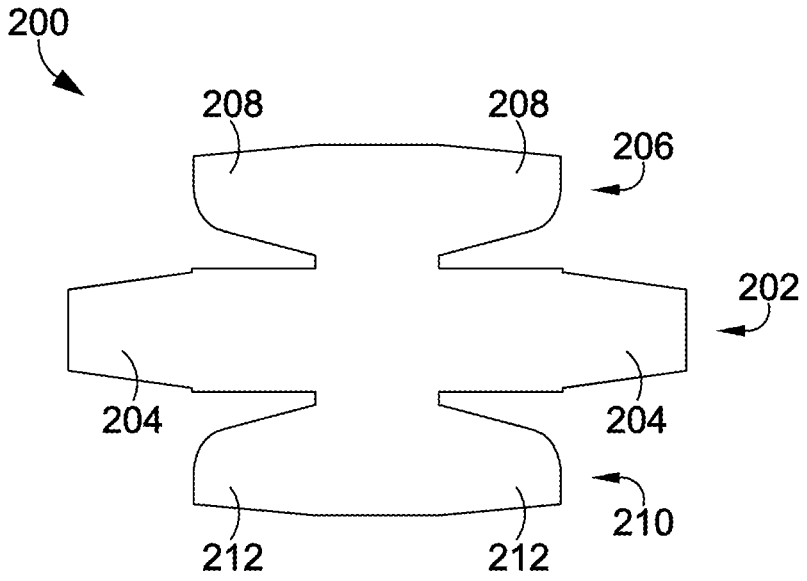
FIG. 3 is a plan view of a substrate blank template, in accordance with an embodiment of the invention.

According to further embodiments of the invention, FIG. 3 illustrates an exemplary substrate blank 200. Although depicted in a "cut out" format, in some aspects, the substrate blank 200 may include a surrounding substrate template for removal around a perimeter of the substrate blank 200, such as a perforated substrate blank 200. The exemplary substrate blank 200 comprises a central portion 202 positioned between a first outer portion 206 and a second outer portion 210. The central portion 202 may include two central portion extensions 204 extending in opposite directions. Similarly, the first outer portion 206 may have two first outer portion extensions 208 extending in opposite directions, while the second outer portion 210 may have two second outer portion extensions 212 extending in opposite directions. The first outer portion extensions 208 and the second outer portion extensions 212 may be generally parallel to the central portion extensions 204. In some aspects, the central portion extensions 204 are longer than the first and second outer portion extensions 208 and 212, respectively. Further, the substrate blank 200 may be configured to be inserted into the die area 16 of a box making apparatus 10 to be folded into a multi-dimensional shape. The substrate blank 200 may be configured such that a cube-shaped box is formed by the box making apparatus 10, such as a cube formed in response to contact of at least a portion of the apparatus 10 with the substrate blank 200.

In various embodiments of the invention, the substrate blank 200 may be made of a variety of flat, pliable substrates. In one aspect, the substrate may be thick enough to resist tearing easily but not so thick as to be difficult to fold properly. For example, the substrate blank 200 may be comprised of cardstock having a weight within a range of about 8 pt. to about 12 pt. In one embodiment, a preferred thickness of cardstock for using as a substrate blank 200 is 8 pt. The substrate blank 200 could also be comprised of metal foils of an appropriate thickness. The metal foil could be comprised of aluminum, copper, brass, or the like. In embodiments, the substrate blank may be pre-decorated with a printed design and/or other embellishments or may be undecorated. As such, at least one surface of the substrate blank 200 may be colored by a user, either before or after manipulation by the apparatus 10, according to some aspects.

Figure 4B:
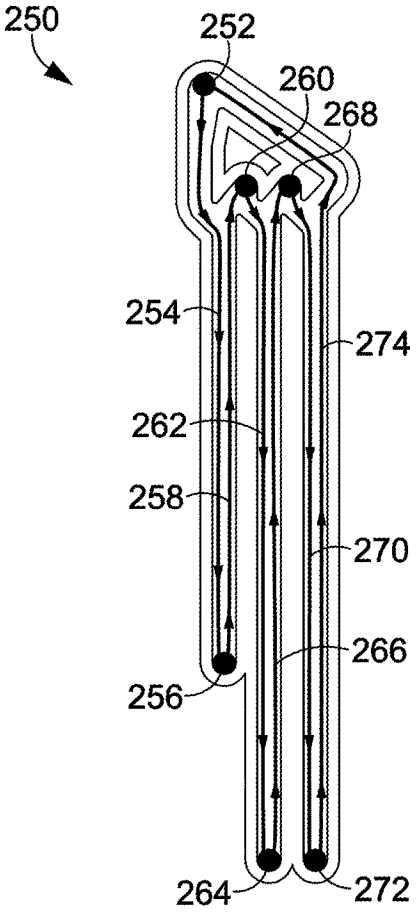
FIG. 4B is an enlarged view of the cam path of FIG. 4A, in accordance with an embodiment of the invention.
Figure 4A:
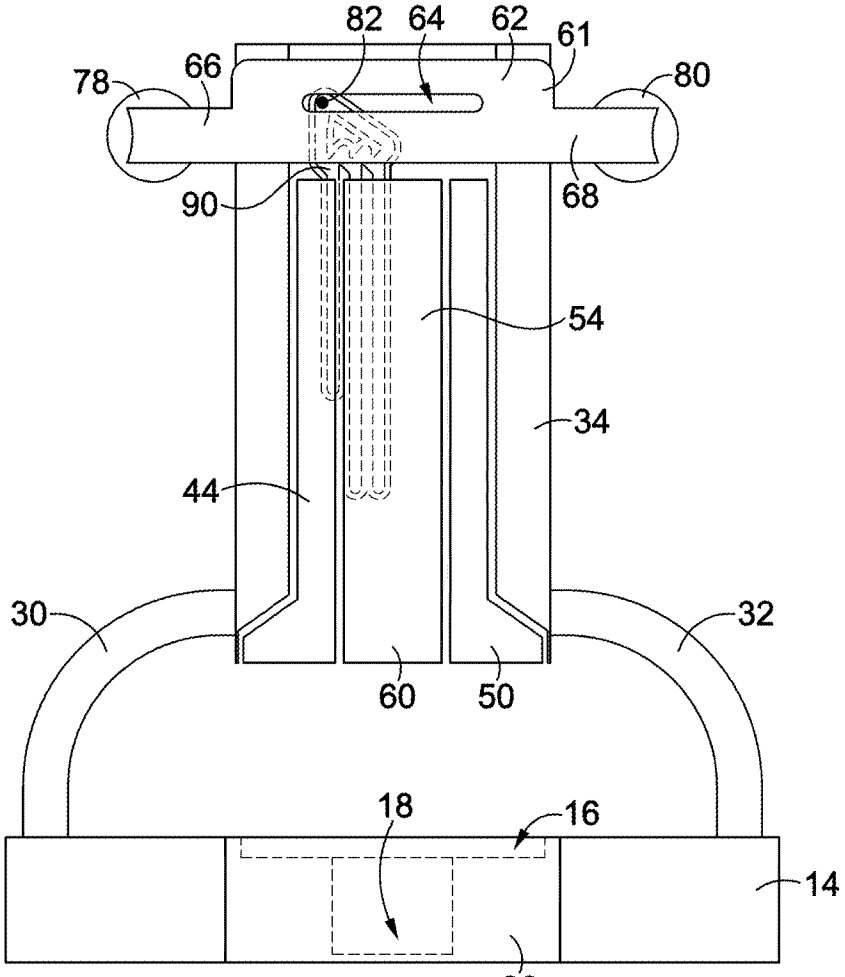
FIG. 4A is a front, cross-sectional view of a box making apparatus, in accordance with an embodiment of the invention.

Turning to FIG. 4A, an exemplary apparatus for folding flat substrates into multi-dimensional shapes is illustrated in a cross-sectional view. In the exemplary embodiment, the die area 16 and depression 18 are shown behind the release drawer 26 in the base 14 of the box making apparatus 10. In one aspect, the left base support 30 and right base support 32 attach the internal housing 34 to the base 14. Additionally, the internal box plunger 54 is shown within the scoring plunger 44, which is located inside the internal housing 34. The front handle element 62 is visible along with the plunger rod 82 extending through the first plunger rod guide slot 64, according to one embodiment of the invention. An outline of the first cam path 90 is also shown.

As previously mentioned, the box making apparatus 10 imposes different sets of folds onto the substrate blank, and the sets of folds are based on the die used to contact the substrate. Additionally, the box-making apparatus 10 may impose different degrees of depression and/or folding onto the substrate based on which die mechanism contacts the substrate blank 200 in which position. In exemplary aspects, at least the scoring die 50 on the scoring plunger 44 is used to make a first set of folds, while only the box die 60 on the internal box plunger 54 is used to make a second set of folds and, optionally, a third set of folds. Accordingly, the box making apparatus 10 may utilize a plunger adjustment mechanism to adjust use of the scoring plunger 44 and the internal box plunger 54. Embodiments of the invention include automatic plunger adjustment mechanisms that transition between at least a first and second position to engage one or more specific die features without direct user interaction with the particular die selected for manipulation by the plunger action of the apparatus 10. In further embodiments of the invention, a manual plunger adjustment mechanism may be used to transition between at least a first and second position to engage one or more specific die features, utilizing direct user interaction with at least a portion of the selected die for engaging with the plunger.

In some aspects, the first cam path 90 and the second cam path 100 (shown in FIG. 2) are used as the plunger adjustment mechanism. FIG. 4B provides a diagram of a cam path 250 in accordance with the present invention, to illustrate how the first cam path 90 and the second cam path 100 are used to adjust between operation of the scoring plunger 44 and/or the internal box plunger 54. For example, the diagram illustrates the path that the plunger rod 82 takes during the function of the box making apparatus 10 to fold a substrate blank 200 into a box, which is explained further below. In one embodiment, the plunger rod 82 begins at a home position 252 before traveling downward along a path 254 to the first cycle fold position 256. From there, the plunger rod 82 travels along a path 258 to the second cycle start position 260 before traveling a path 262 to the second cycle fold position 264. In further aspects, the plunger rod 82 travels along a path 266 to the third cycle start position 268 before finally following a path 270 to the third cycle fold position 272. In further embodiments, the plunger rod 82 then returns to the home position 252 via a path 274.

Figure 5B:
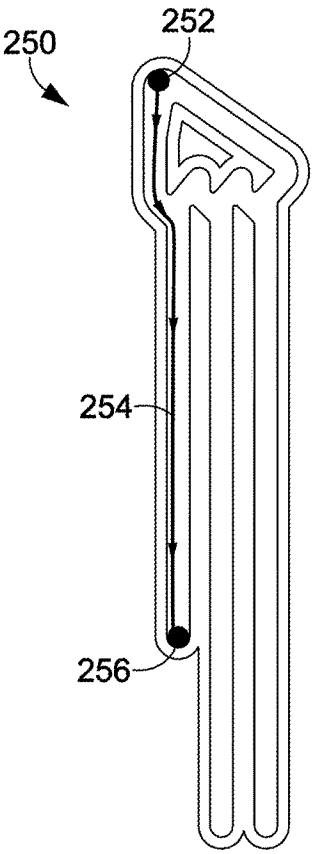
FIG. 5B is an enlarged view of the cam path of FIG. 5A, in accordance with an embodiment of the invention.
Figure 5A:
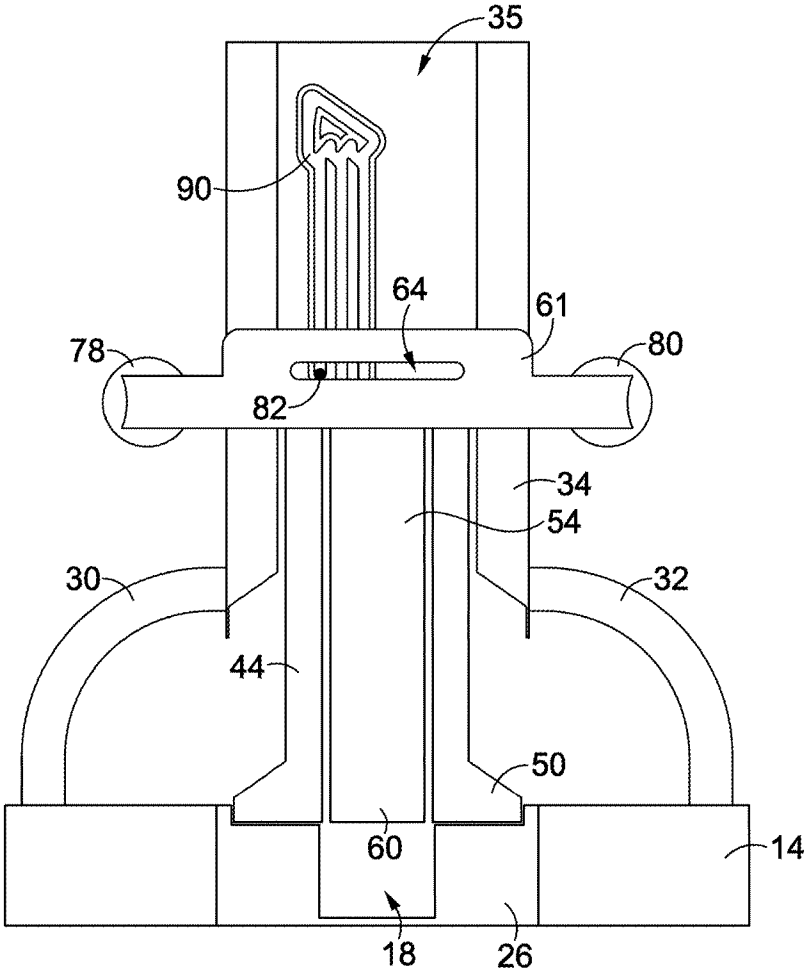
FIG. 5A is a front, cross-sectional view of a box making apparatus, in accordance with an embodiment of the invention.
Figure 5D:
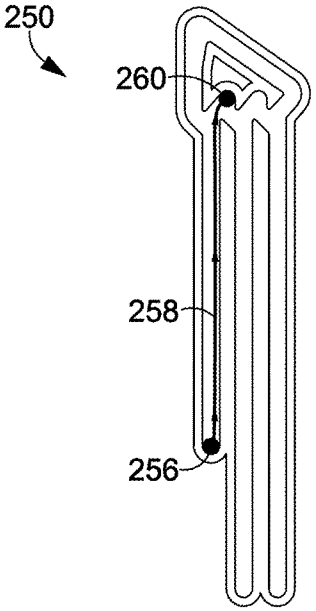
FIG. 5D is an enlarged view of the cam path of FIG. 5C, in accordance with an embodiment of the invention.

A method of forming a box from pliable substrates is depicted in the examples of FIGS. 5A-7E. In one embodiment, the box-making process begins by placing a substrate blank 200 (not shown) into the die area 16 of the base 14. The handle 61 is depressed a first time, moving the handle 61 from an original position (as shown in FIG. 4A) to a first depressed position, as illustrated in FIG. 5A. In embodiments, as the handle 61 travels downward relative to the base 14, the plunger rod 82 is guided along the first cam path 90 from the home position 252 to the first cycle fold position 256 along a path 254. Though not visible in the view illustrated, the plunger rod 82 may also be guided along the second cam path 100 in a similar manner. Additionally, as the plunger rod 82 travels downward along path 254, it engages the top portion 46 of the scoring plunger 44, moving the scoring plunger 44 downward towards the base 14. In this first depressed position, the scoring die 50 of the scoring plunger 44 engages with the die area 16 to create a first set of folds in the substrate blank 200. As the scoring plunger 44 moves downward, the internal box plunger 54, which is positioned within the scoring channel 52 of the scoring plunger 44, also moves.

Figure 5E:
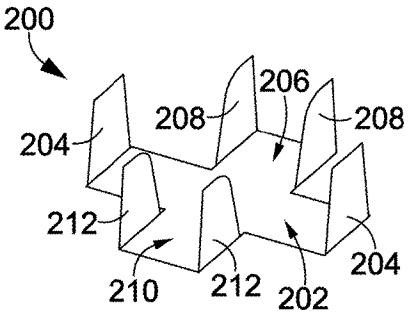
FIG. 5E is a perspective view of a partially folded substrate blank, in accordance with an embodiment of the invention.
Figure 5C:
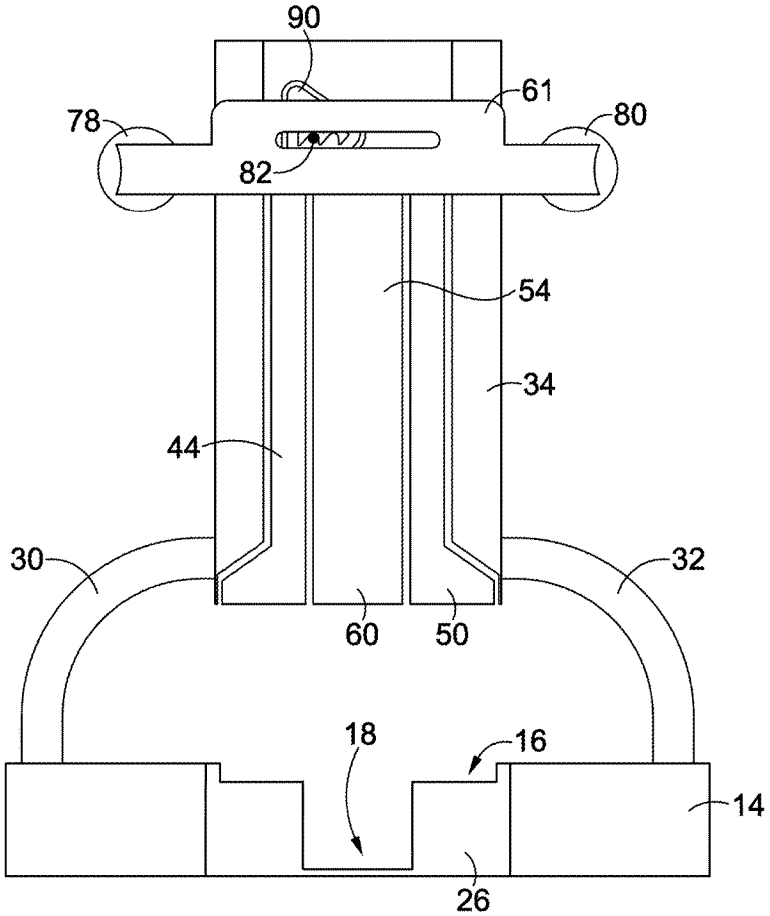
FIG. 5C is a front, cross-sectional view of a box making apparatus, in accordance with an embodiment of the invention.

Accordingly, as the handle 61 is released, one or more springs and/or tensioning mechanism, such as springs 108 and 110, provide tension to propel the scoring plunger 44, along with the internal box plunger, and/or the handle 61 to the original position, as shown in FIG. 5C. In one embodiment, the plunger rod 82 travels along a path 258 to the second cycle start position 260. At this point, the substrate blank 200 is folded in accordance with the first set of folds created by the scoring die 50, as shown in FIG. 5E. In some aspects, this first set of folds includes six folds made such that the central portion extensions 204, the first outer portion extensions 208, and the second outer portion extensions 212 are all folded at right angles with respect to their respective portions, forming a cross shape.

Figure 6B:
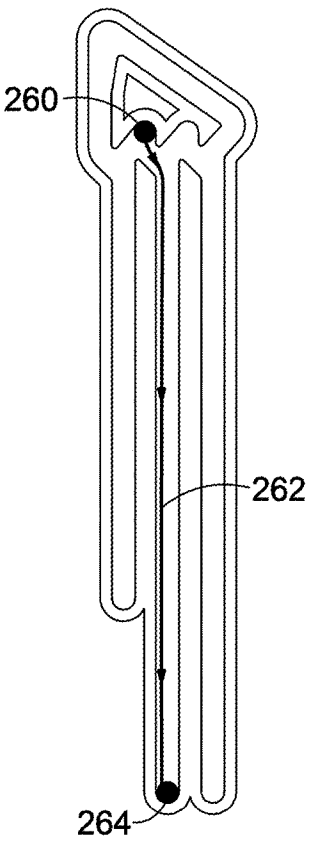
FIG. 6B is an enlarged view of the cam path of FIG. 6A, in accordance with an embodiment of the invention.
Figure 6A:
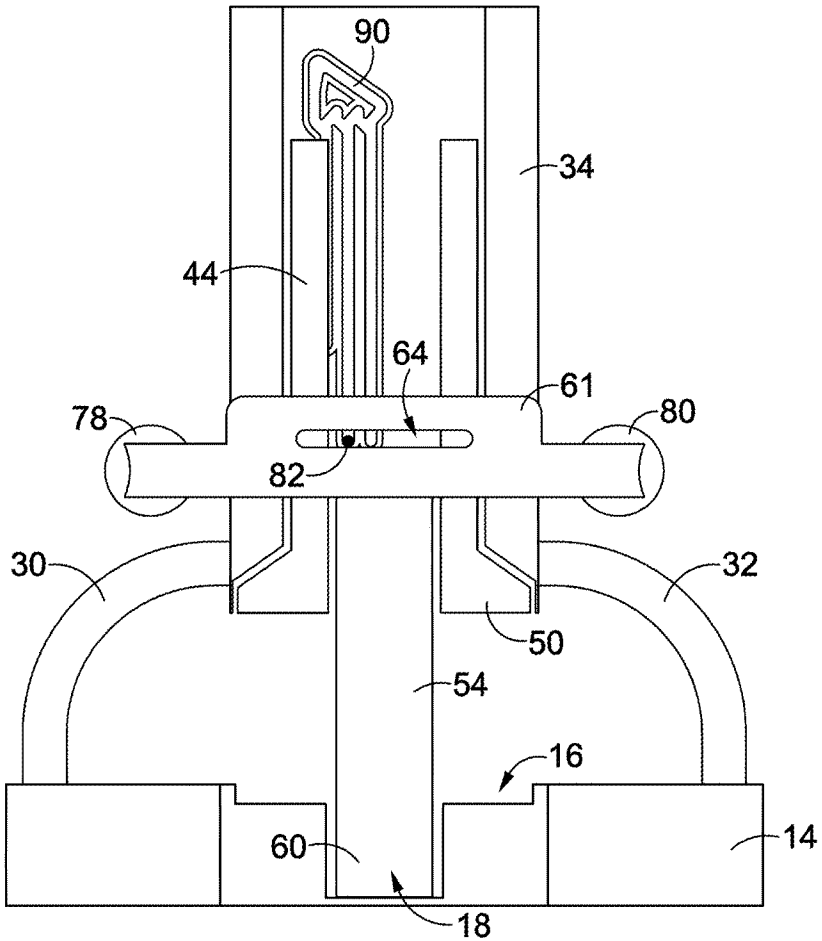
FIG. 6A is a front, cross-sectional view of a box making apparatus, in accordance with an embodiment of the invention.
Figure 6D:
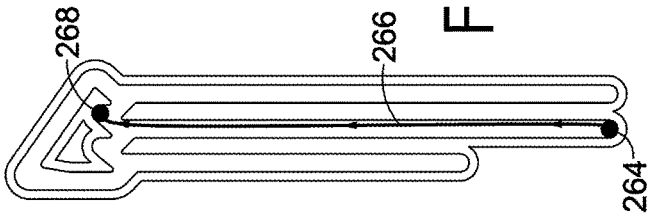
FIG. 6D is an enlarged view of the cam path of FIG. 6C, in accordance with an embodiment of the invention.

FIG. 6A illustrates depressing the handle 61 a second time, moving the handle 61 from the original position to a second depressed position. In embodiments, as the handle 61 moves downward relative to the base 14, the plunger rod 82 is guided along the cam path 90 from the second cycle start position 260 along a path 262 to the second cycle fold position 264. In one embodiment of the invention, as the plunger rod 82 travels downward, it engages the top portion 56 of the internal box plunger 54, moving it downward towards the base 14. Unlike with the first depressed position, only the internal box plunger 54 is moved downward, while the scoring plunger 44 remains in its initial, elevated position. In this second depressed position, the box die 60 of the internal box plunger 54 engages with the well 28 of the release drawer 26 within the depression 18 of the base 14 to create a second set of folds in the substrate blank 200.

Figure 6E:
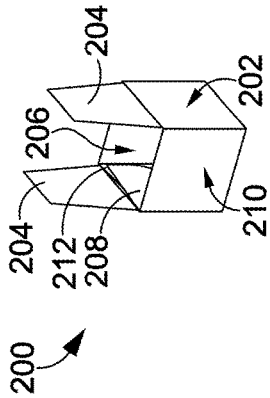
FIG. 6E is a perspective view of a partially folded substrate blank, in accordance with an embodiment of the invention.
Figure 6C:
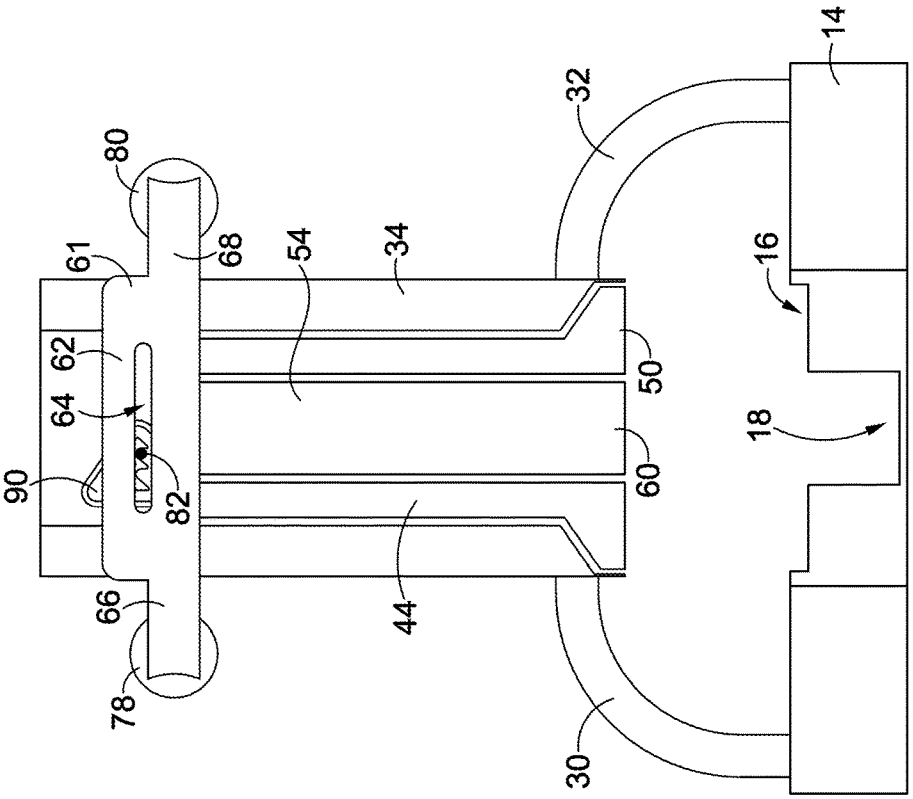
FIG. 6C is a front, cross-sectional view of a box making apparatus, in accordance with an embodiment of the invention.

In one aspect, as the handle 61 is released, one or more springs, such as springs 108 and 110, provide tension to propel the internal box plunger 54 and the handle 61 to the original position, as shown in FIG. 6C. The plunger rod 82 travels along a path 266 to the third cycle start position 268. As such, the substrate blank 200 is now folded as shown in FIG. 6E. The second set of folds creates four folds in the substrate blank 200 such that the four prongs of the cross shape are bent at a right angle and the first outer portion extensions 208 overlap with the second outer portion extensions 212. Though FIG. 6E illustrates the first outer portion extension 208 being more interior than the second outer portion extension 212, the second outer portion extensions 212 may be more interior than the first outer portion extensions 208 when overlapping in other embodiments. In one aspect, the central portion extensions 204 remain exposed, parallel to the longitudinal axis 20 of the apparatus 10.

Figure 7B:
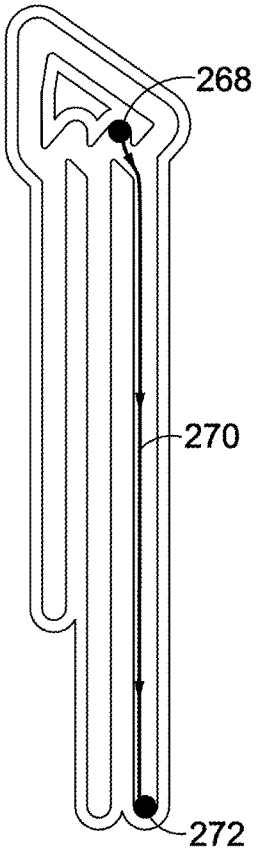
FIG. 7B is an enlarged view of the cam path of FIG. 7A, in accordance with an embodiment of the invention.
Figure 7A:
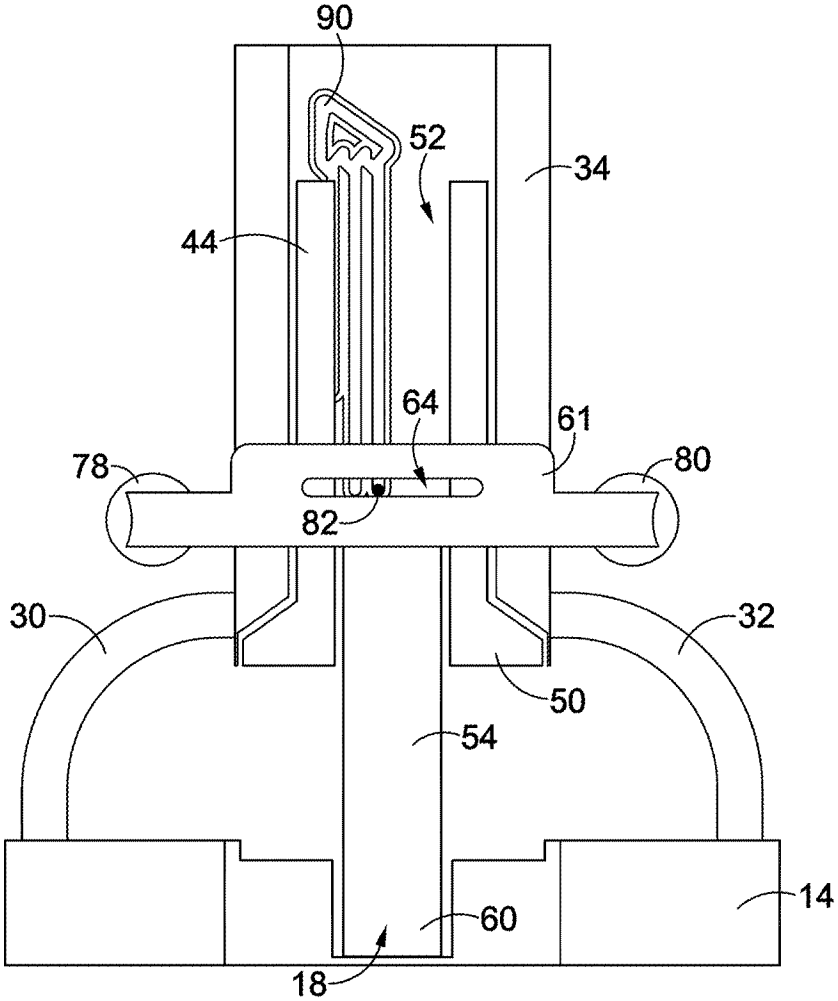
FIG. 7A is a front, cross-sectional view of a box making apparatus, in accordance with an embodiment of the invention.
Figure 7D:
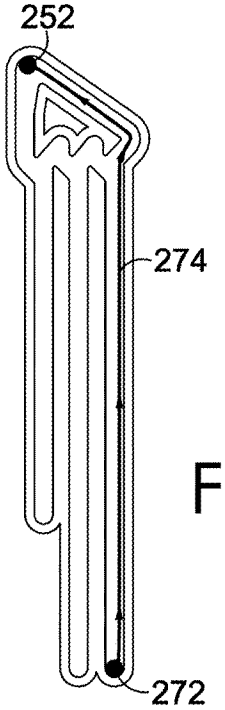
FIG. 7D is an enlarged view of the cam path of FIG. 7C, in accordance with an embodiment of the invention.
Figure 7E:
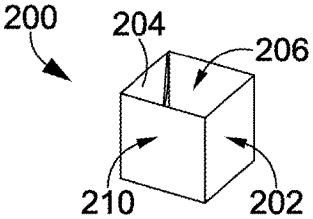
FIG. 7E is a perspective view of a folded substrate blank, in accordance with an embodiment of the invention.
Figure 7C:
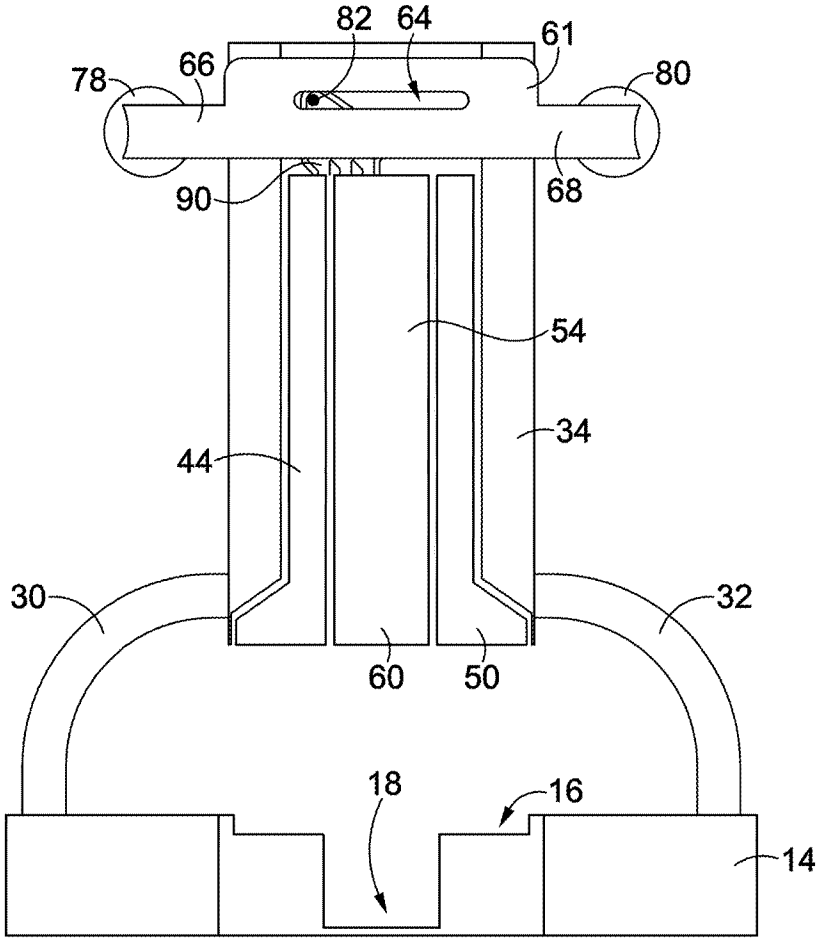
FIG. 7C is a front, cross-sectional view of a box making apparatus, in accordance with an embodiment of the invention.

In further embodiments of the invention, the handle 61 is depressed a third time, moving the handle 61 from an original position (as shown in FIG. 4A) to the third depressed position, as illustrated in FIG. 7A. In one embodiment, as the handle 61 travels downward relative to the base 14, the plunger rod 82 is guided along the cam path 90 from the third cycle start position 268 to the third cycle fold position 272 along a path 270. As the plunger rod 82 travels downward, it engages the top portion 56 of the internal box plunger 54, moving it downward towards the base 14. Like with the second depressed position, the scoring plunger 44 remains in place as the internal box plunger 54 is moved towards the base 14. In this third depressed position, the box die 60 of the internal box plunger 54 once again engages with the well 28 of the release drawer 26 within the depression 18 of the base 14 to create a third set of folds in the substrate blank 200, pressing the central portion extensions 204 of the central portion 202 down into a hollow center of the partially-formed box. In embodiments, as the handle 61 is released, one or more springs, such as springs 108 and 110, provide tension to propel the internal box plunger 54 and the handle 61 to the original position, as shown in FIG. 7C. Further, the plunger rod 82 travels along a path 274 back to the home position 252. FIG. 7E illustrates the resulting box with an open top, according to one embodiment of the invention.

Figure 8A:
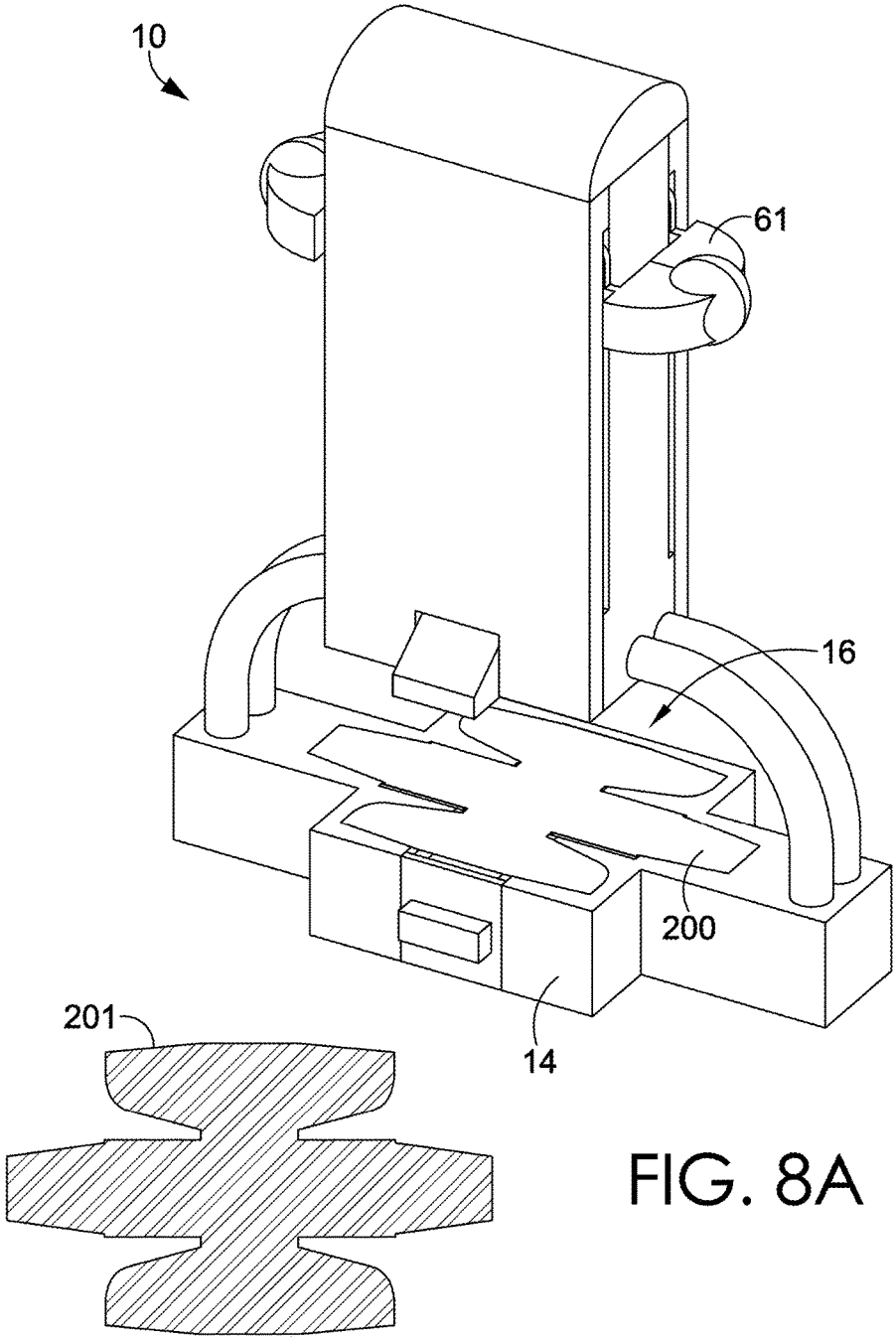
FIG. 8A is a perspective view of a box making apparatus folding a substrate blank, in accordance with an embodiment of the invention.

FIGS. 8A-8E depict another view of the apparatus and method of forming a box from a pliable substrate using the box making apparatus 10 of FIG. 4A. In FIG. 8A, a substrate blank 200 has been inserted into the die area 16 of the base 14, and the handle 61 is in its original position. FIG. 8A also provides a plan view of the substrate blank having a printed design 201. The design 201 may be printed on only one side of the substrate blank 200 such that the opposite side of the substrate blank 200 has no design. In this aspect, the substrate blank 200 may be inserted into the die area 16 of the base with the side having the printed design 201 facing downward so that the printed design 201 may be facing outward after the substrate blank 200 is folded into a box in accordance with embodiments of this invention.

Figure 8B:
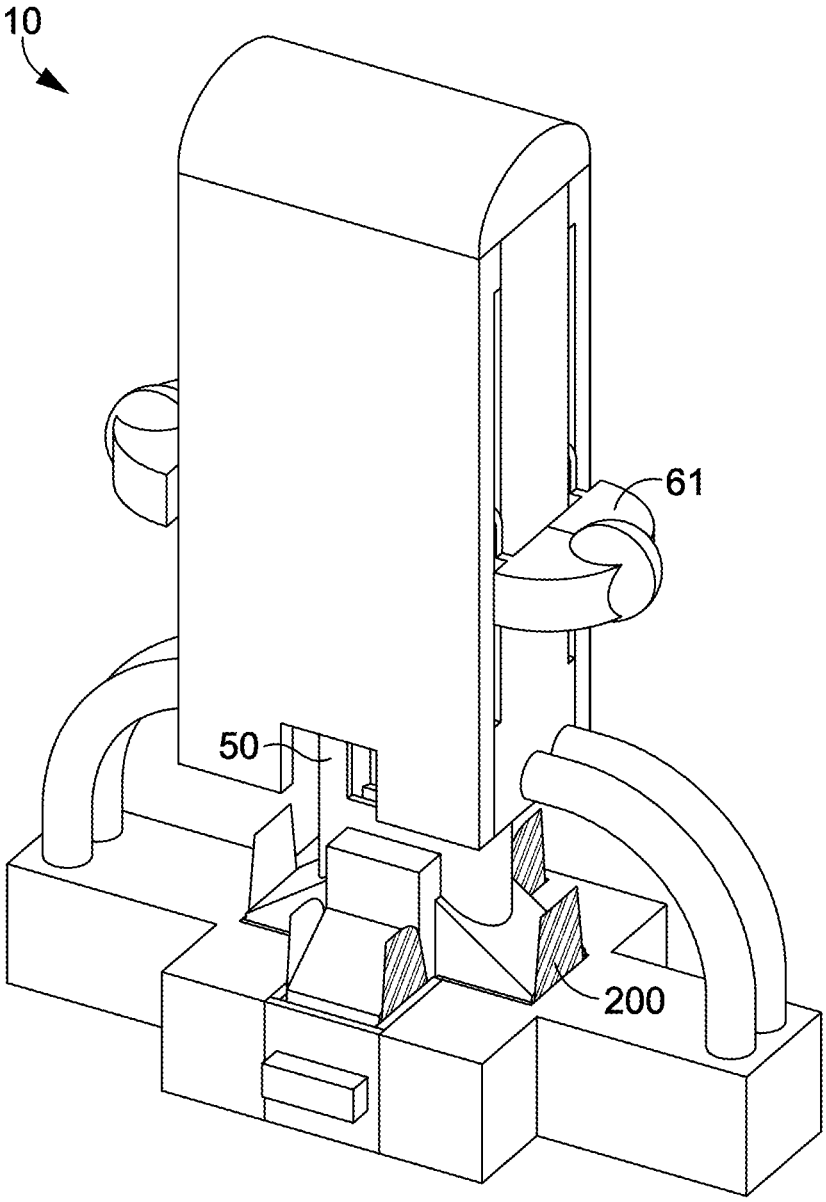
FIG. 8B is a perspective view of the box making apparatus of FIG. 8A, in accordance with an embodiment of the invention.
Figure 8C:
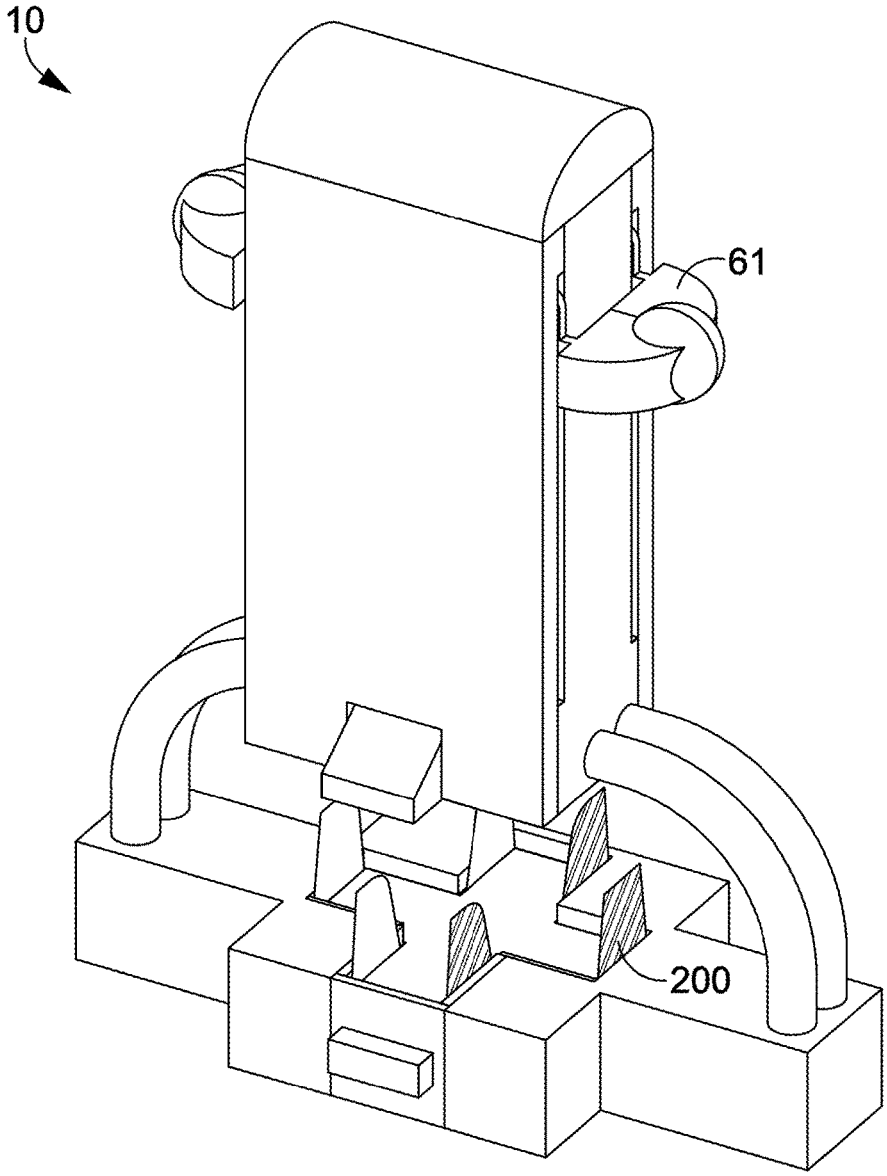
FIG. 8C is a perspective view of the box making apparatus of FIG. 8A, in accordance with an embodiment of the invention.
Figure 8D:
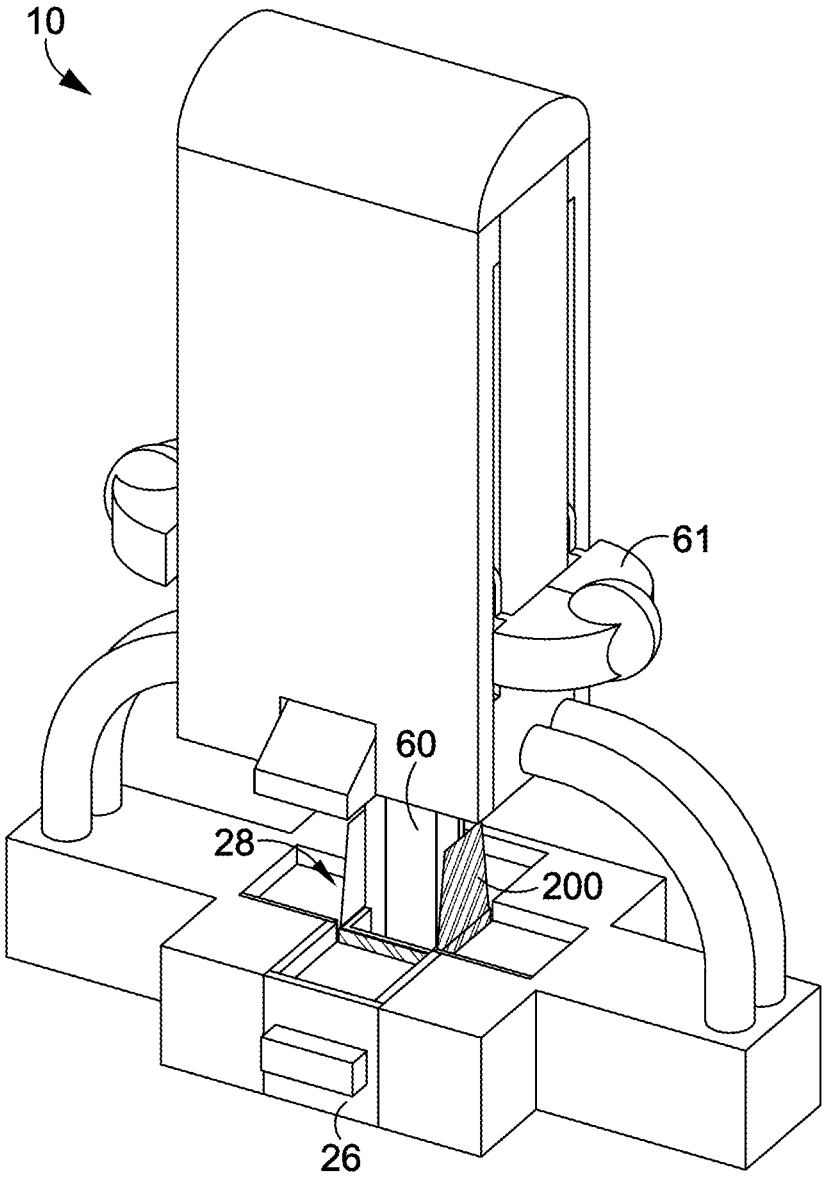
FIG. 8D is a perspective view of the box making apparatus of FIG. 8A, in accordance with an embodiment of the invention.
Figure 8E:
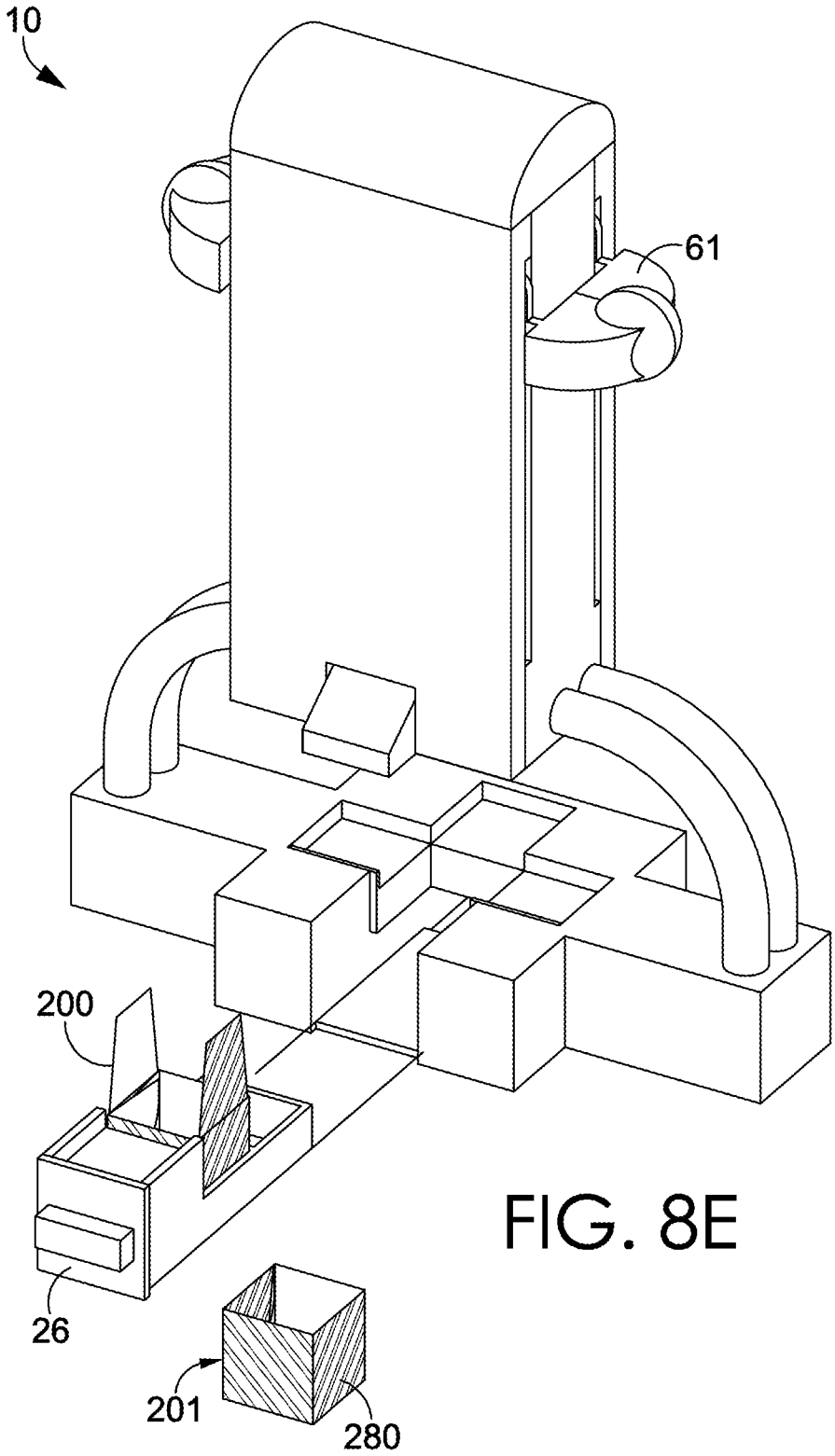
FIG. 8E is a perspective view of the box making apparatus of FIG. 8A, in accordance with an embodiment of the invention.

FIG. 8B illustrates the handle 61 being depressed a first time to a first depressed position such that the scoring die 50 creates a first set of folds in the substrate blank 200. FIG. 8C shows the handle 61 after it has returned to its original position, and the substrate blank 200 can been seen with the first set of folds. In FIG. 8D, the handle is depressed a second time to a second depressed position, wherein the box die 60 engages the well 28 of the release drawer 26 to create a second set of folds in the substrate blank 200. FIG. 8E depicts the apparatus 10 after the handle 61 has been released a second time, returning the handle 61 to its original position. The mechanics of the apparatus 10 shown in FIGS. 8A-8E are similar to those described more fully with respect to FIGS. 5A-6E.

Figure 9:
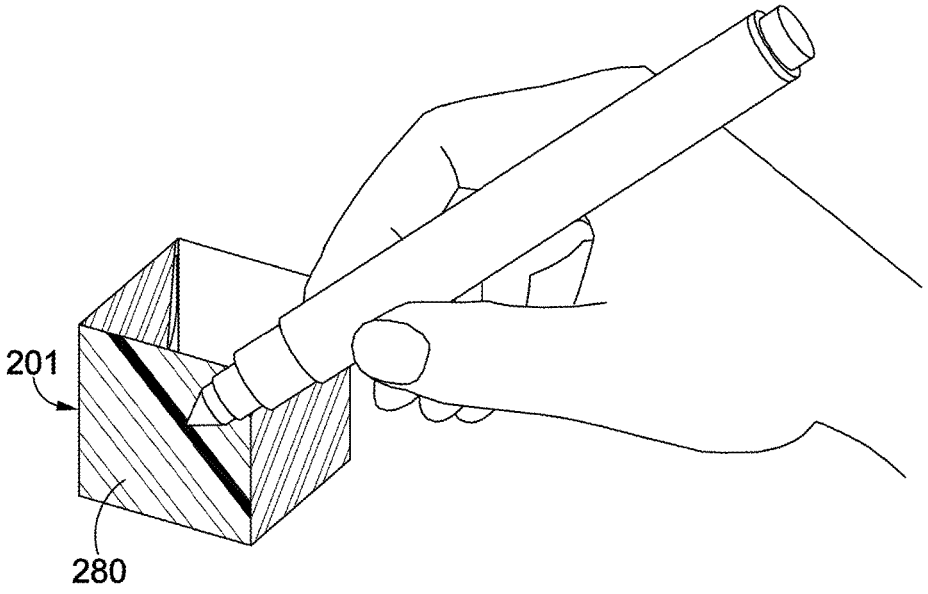
FIG. 9 is a perspective view of a substrate blank folded into a box, in accordance with an embodiment of the invention.

The release drawer 26 has been removed to reveal a partially folded substrate blank 200, in the embodiment of FIG. 8E. In this embodiment, the box-making apparatus 10 performs only two folding cycles, and the extending portions of the substrate blank 200 are folded into the partially formed box by a user. An example of a completely folded box 280 is shown next to the apparatus 10. The completely folded box 280 may include the printed design 201, as shown in the example of FIG. 9.

Figure 10:
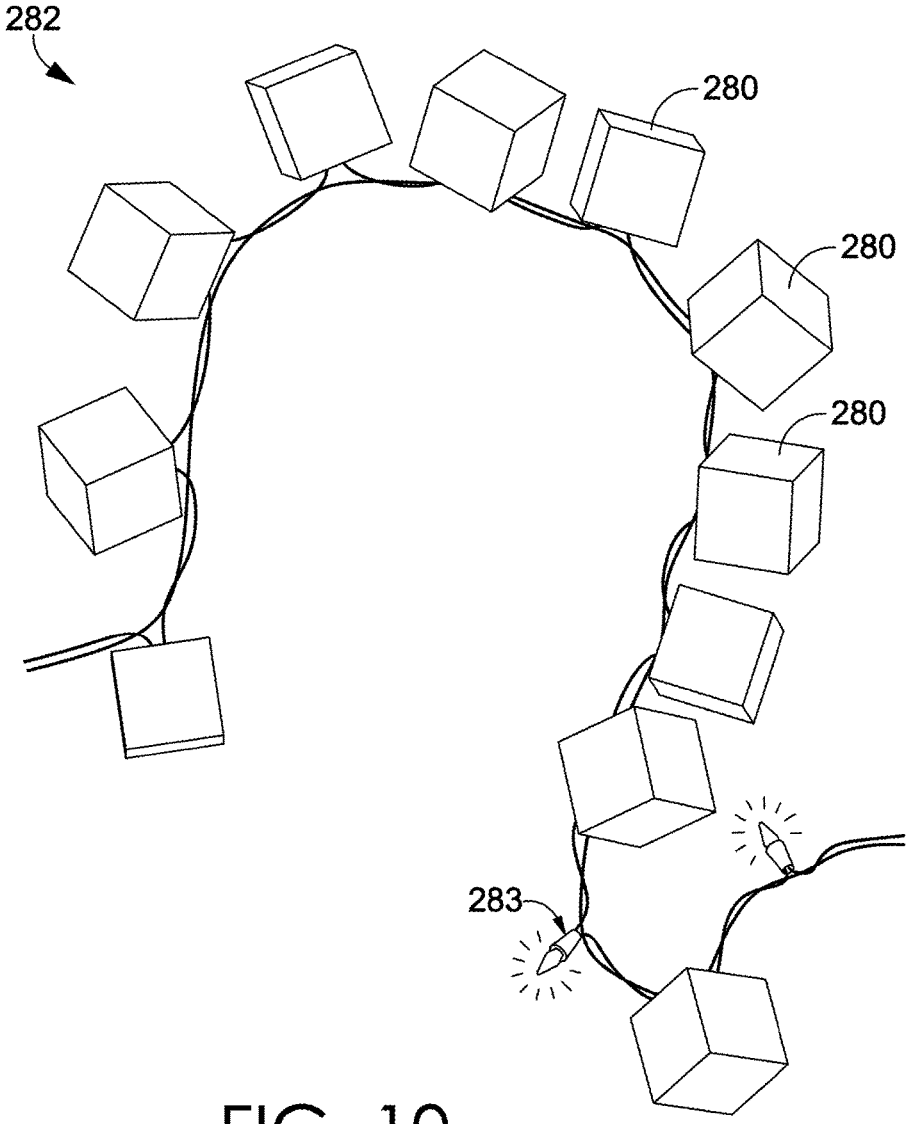
FIG. 10 depicts an exemplary use of boxes made with the box making apparatus, in accordance with an embodiment of the invention.
Figure 11A:
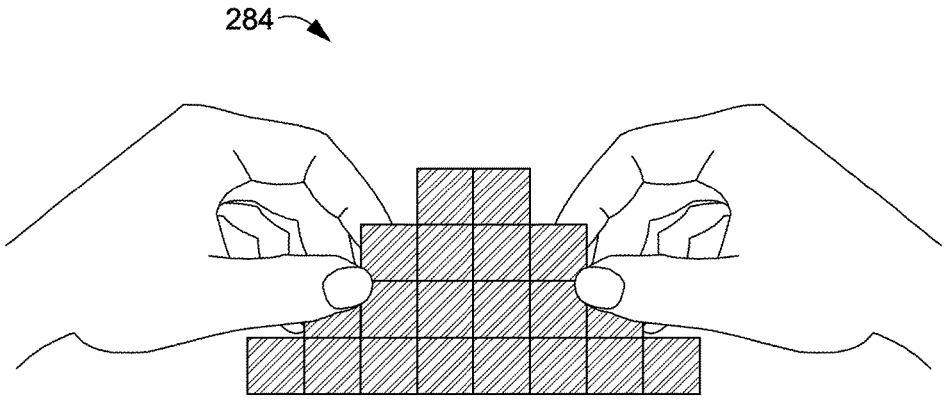
FIGS. 11A-D depict exemplary uses of boxes made with the box making apparatus, in accordance with an embodiment of the invention.
Figure 11B:
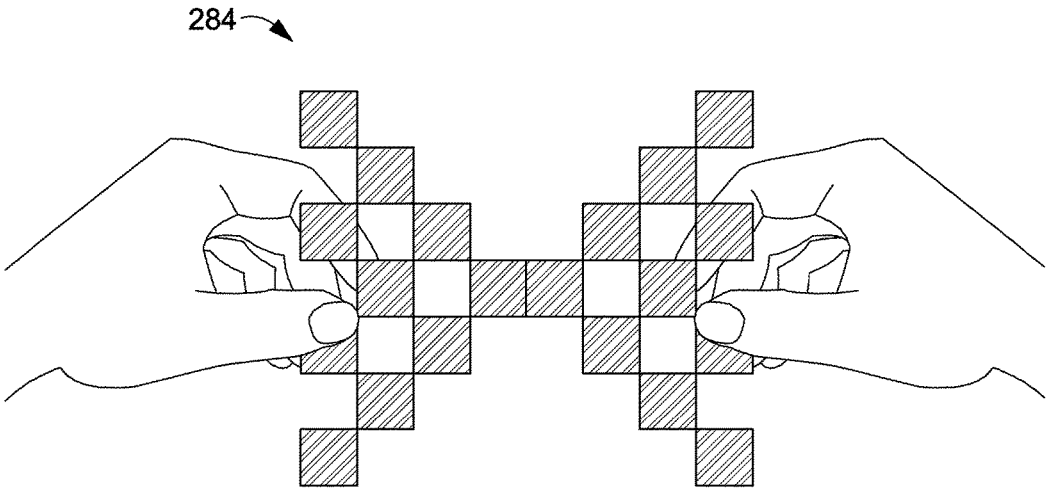
Figure 11C:
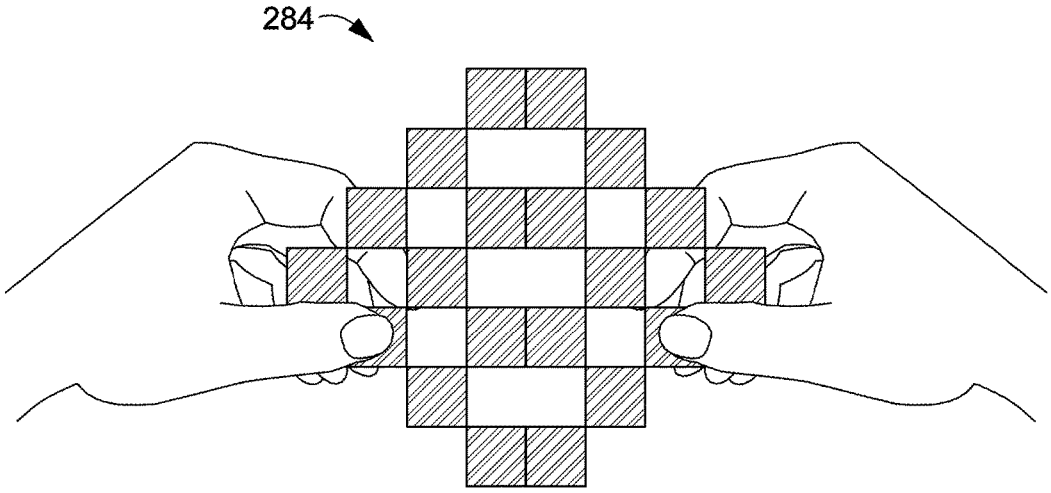
Figure 11D:
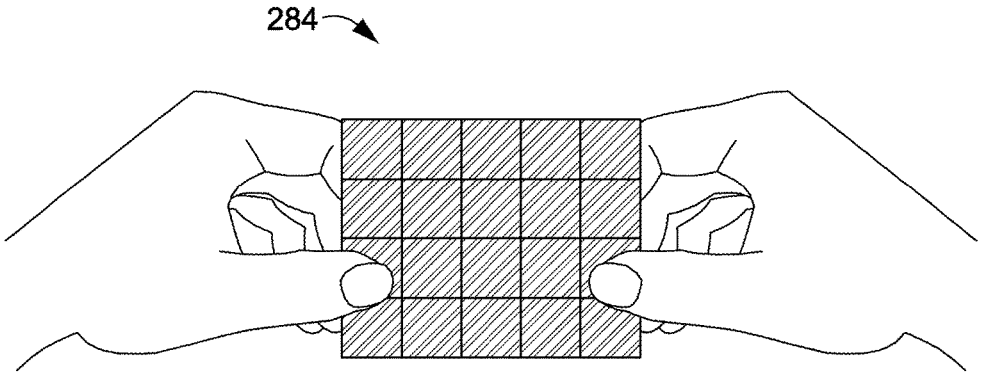
Figure 12:
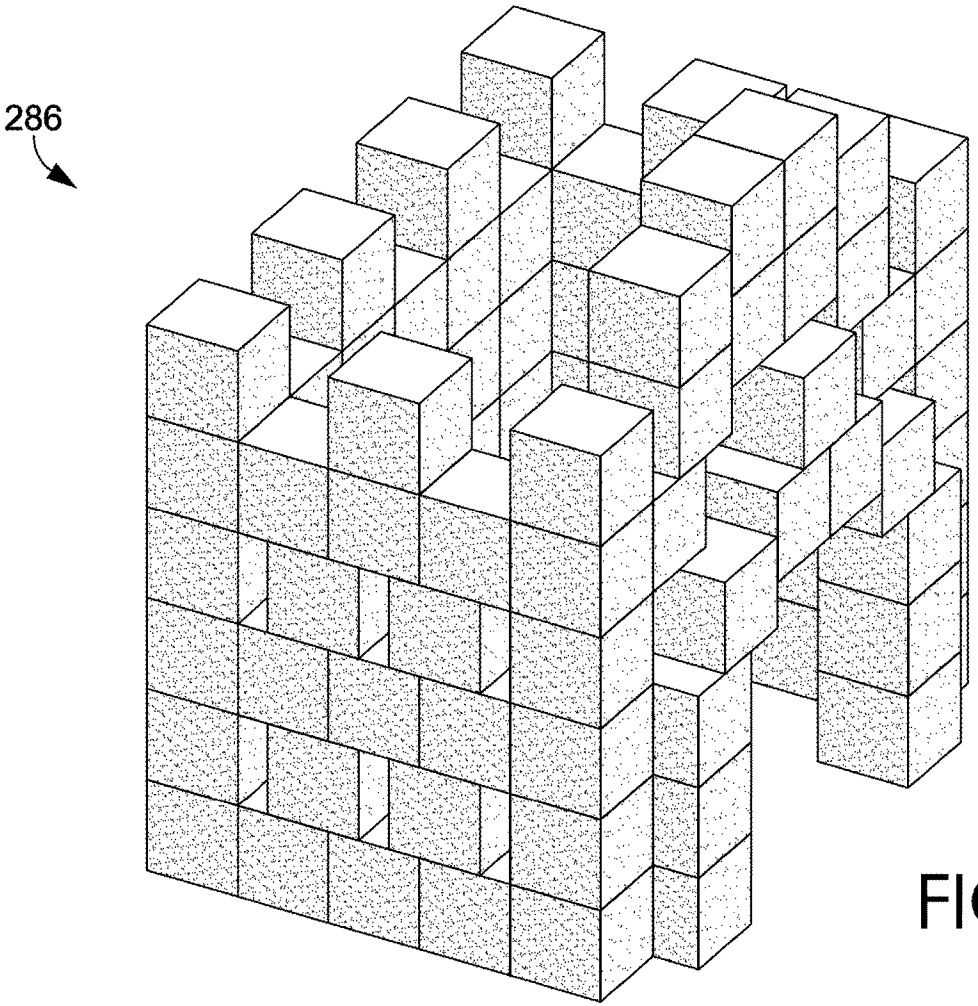
FIG. 12 depicts an exemplary use of boxes made with the box making apparatus, according to embodiments of the invention.

There are several uses for the folded boxes 280 that are created by the box making apparatus 10, according to various embodiments of the invention. FIG. 9 shows a folded box 280 being decorated with a marker. The folded box 280 in FIG. 9 includes the printed design 201 being colored by the user, but it is contemplated that a user may decorate a folded box 280 that does not have a printed design. FIG. 10 illustrates a possible use for several folded boxes 280. The boxes 280 could be placed over individual LED lights 283 in a string of lights to create decorative lights 282. The boxes 280 could also be assembled into articulating sculptures 284, such as the articulating sculpture 284 depicted in FIGS. 11A-11D. Further, the folded boxes 280 could also be used as building blocks, either alone or in combination with additional toy pieces, to create a three-dimensional structure 286, such as the castle depicted in FIG. 12.

In alternative aspects, the substrate blank 200 may be folded into the fold box 280 with a box-making apparatus having other means for adjusting the plungers to provide the various fold cycles. For example, turning to FIGS. 13-14, an alternative embodiment of the box making apparatus 300 is provided. Box making apparatus 300 may comprise a base 304 having a die area 306 and a depression 308, similar to base 14 discussed with respect to FIGS. 1-2. The depression 308 may be in a central portion of the die area 306 and have a rectangular shape. In one aspect, the depression 308 may be square in shape, and centered in a middle point between an x and y axis of the die area 306. Adjacent each side of the depression 308 may be shelves 312 on which at least a portion of a substrate blank, such as substrate blank 200, rests. For example, die area 306 includes a front shelf 312A, a right shelf 312B, a back shelf 312C, and a left shelf 312D. The shelves 312 may provide surfaces raised above the depression 308 and may be a part of the base 304 itself or formed from a drawer within the base 304, such as release drawer 26 in FIG. 1.

Figure 13:
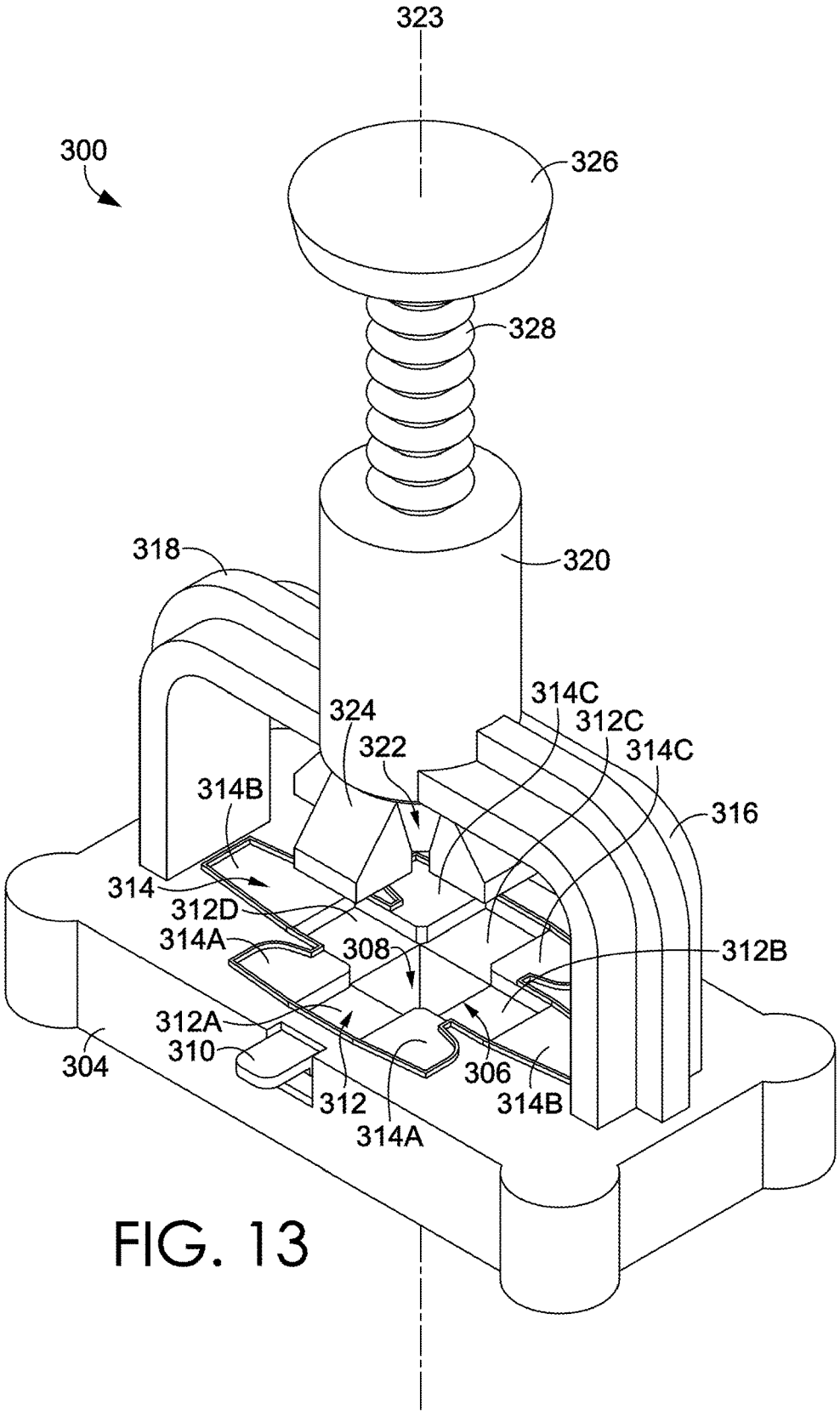
FIG. 13 is a perspective view of a box making apparatus, in accordance with an embodiment of the invention.

In some embodiments, such as the one illustrated in FIG. 13, the shelves 312 of the die area 306 form a cross shape and do not exactly match the shape of the substrate blank 200 in its unfolded form. Accordingly, the die area 306 may also include extension indentions 314 around the periphery of the shelves 312 to provide surfaces for the extensions portions of the substrate blank 200. For instance, in FIG. 13, there are two front extension indention 314A corresponding to the first outer portion extensions 208 of substrate blank 200 and two back extension indentions 314C corresponding to the second outer portion extensions 212. Similarly, there may be two central extension indentions 314B corresponding to the central portion extensions 204 of the substrate blank 200. The surfaces provided by the extension indentions 314 may be slightly raised above the shelves 312 but set below the surface of the base 304. As such, a perimeter of the die area 306 may include an outer edge of at least a portion of each of the extension indentions 314 and/or at least apportion of each of the shelves 312. In other words, the die area 306 may be depressed below a top surface of the base 304 at different depths—i.e., a first depth corresponding to each extension indentation 314, a second depth corresponding to each shelf 312, and a third depth corresponding to the depression 308.

Figure 14:
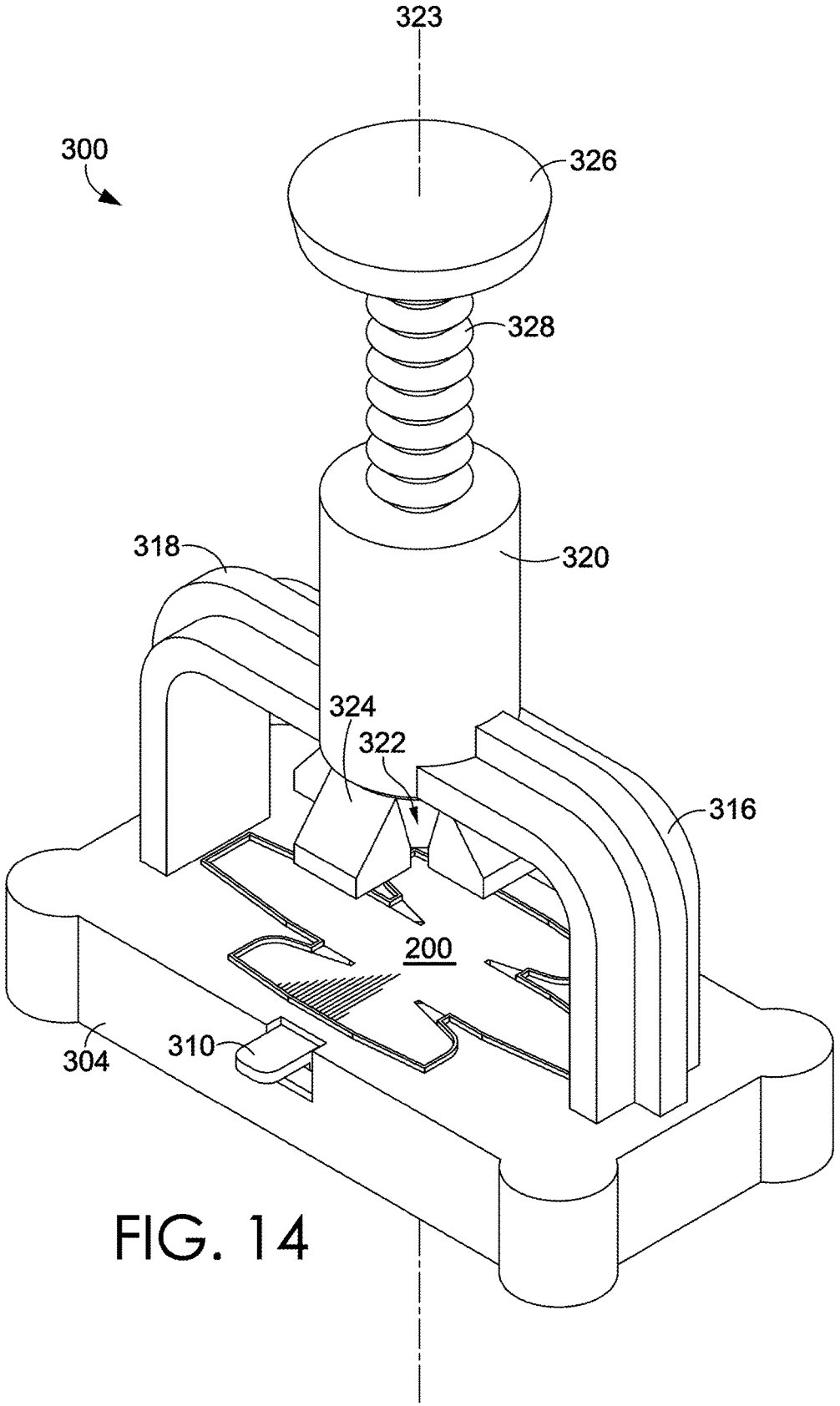
FIG. 14 is a perspective view of the box making apparatus of FIG. 13 with a substrate blank, in accordance with an embodiment of the invention.

FIG. 14 depicts substrate blank 200 placed within the die area 306 prior to being folded. In embodiments, as shown in FIG. 14, the die area 306 may secure the substrate blank 200 with the two front extension indentions 314A corresponding to the first outer portion extensions 208 of substrate blank 200, two back extension indentions 314C corresponding to the second outer portion extensions 212, and two central extension indentions 314B corresponding to the central portion extensions 204 of the substrate blank 200. In some aspects, the mated perimeter of the substrate blank 200 with the surrounding die area 306 is configured to secure the substrate blank 200 with respect to the base 304 during folding maneuvers by the apparatus 300.

The depression 308 may be configured to receive a multi-dimensional shape as it is being formed, according to some aspects. For example, as it is being folded into the folded box 280, the substrate blank 200 may be received into the depression 308, rather than into a well of a drawer received within the depression, as discussed with respect to FIGS. 1-7E. When completed, the folded box 280 may be removed from the depression 308 via a release mechanism such as a release lever 310. As shown in FIGS. 1-7E, however, other release mechanisms, such as a removable drawer, may be used to retrieve the folded box 280.

Continuing, box making apparatus 300 further comprises a housing 320 for one or more plungers. In some aspects, each of the one or more plungers associated with the housing 320 may provide a single function or multiple functions for forming a folded box 280 out of a substrate blank 200. Further, the housing 320 may have an internal channel (not visible in the view shown in FIG. 13) and oriented such that the internal channel is parallel to a longitudinal axis 323 of box making apparatus 300. For example, housing 320 may comprise a cylindrical shape extending in a direction parallel to longitudinal axis 323 and having the internal channel running from the top of the housing 320 to the bottom of the housing 320. In other embodiments, the housing 320 may be generally rectangular shape, similar to internal housing 34 shown in FIG. 2. Additionally, base 304 may be coupled to the housing 320 via a right base support 316 and a left base support 318, similar to right base support 32 and left base support 30 of FIG. 1. In some aspects, a left and right base support 318 and 316 provides a threshold separation distance between the housing 320 and the base 304 such that a user may access the die area 306 for inserting the substrate blank 200, and subsequently removing the formed, folded box 280.

Figure 15:
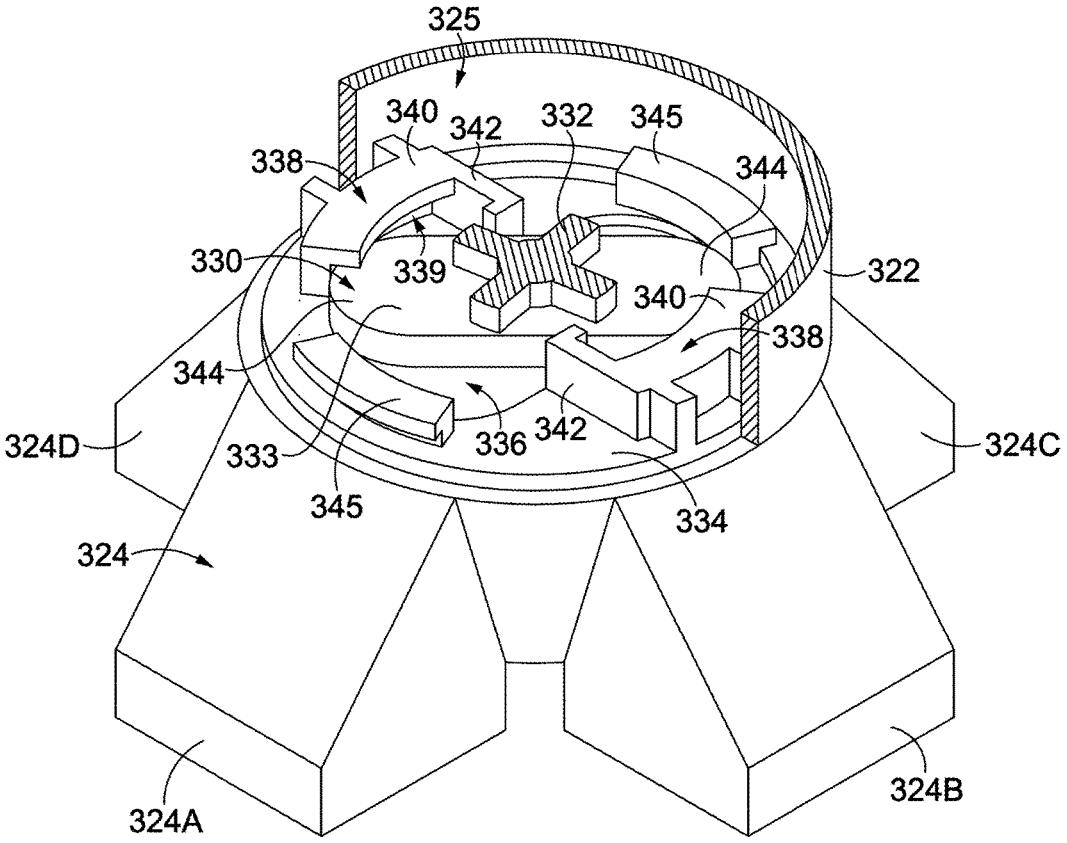
FIG. 15 is an enlarged, perspective view of a plunger adjustment mechanism of the box making apparatus of FIG. 13 with portions removed, in accordance with an embodiment of the invention.
Figure 19:
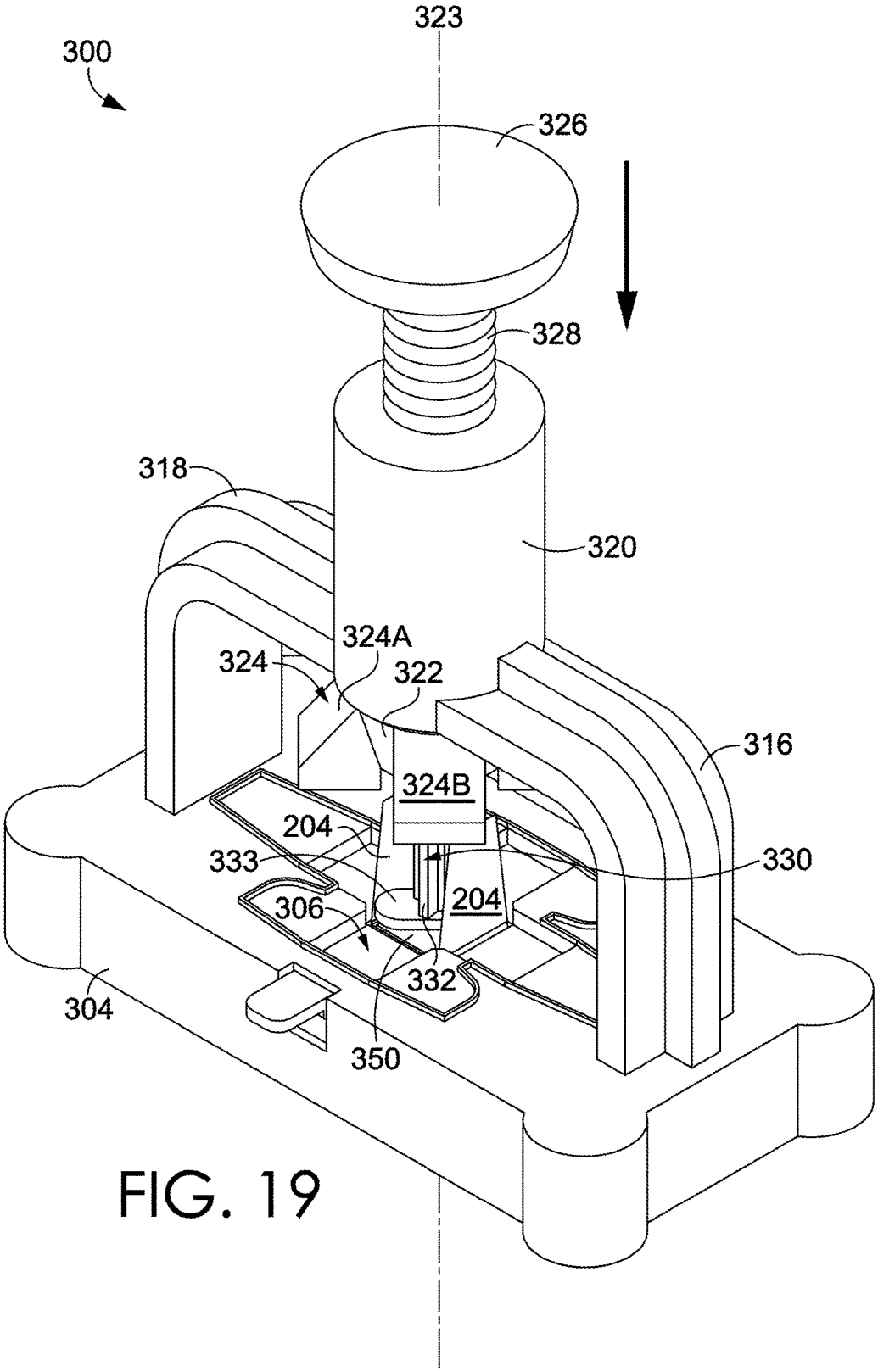
FIG. 19 is a perspective view of the box making apparatus of FIG. 13 in a second depressed position, in accordance with an embodiment of the invention.
Figure 20:
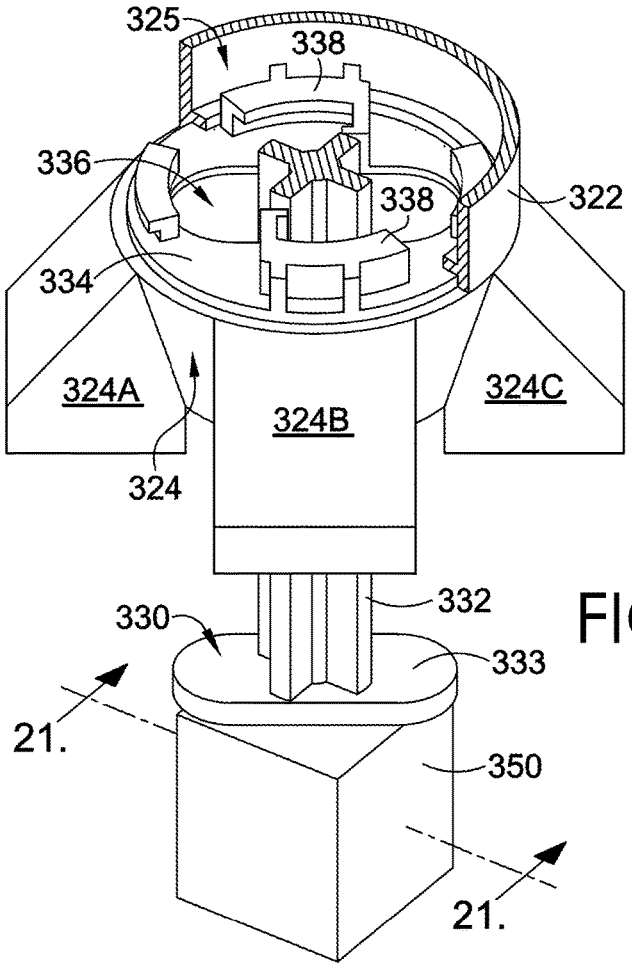
FIG. 20 is an enlarged, perspective view of the plunger adjustment mechanism of the box making apparatus of FIG. 13 with portions removed, in accordance with an embodiment of the invention.

Positioned within the internal channel of housing 320 may be a scoring plunger 322 having a scoring channel 325 (shown in FIG. 15) along the longitudinal axis 323, similar to the scoring plunger 44 in FIG. 2. The scoring plunger 322 may be slideably coupled to the housing 320. A bottom portion of the scoring plunger 322 may be formed with and/or coupled to a scoring die 324, similar to the scoring die 50 in FIG. 2. Additionally, as shown in FIGS. 15, 19 and 20, an internal box plunger 330, similar to internal box plunger 54 of FIG. 2, may be slideably coupled within the scoring channel 325 of the housing 320. In some aspects, a bottom portion of the internal box plunger 330 may be coupled to or form part of a box die 350 (shown in FIG. 20), similar to the box die 60 of FIGS. 1-7E.

The scoring die 324 may comprise a general cross shape having four prongs 324A, 324B, 324C, and 324D. The prongs 324A, 324B, 324C, and 324D may connect to a center portion of the scoring die 324. This center portion may be circular shape, as shown in FIGS. 13-14, or, in other embodiments, may be another shape or combination of shapes, such as a center having a rectangular shape. The center portion of the scoring die 324 may be configured to receive or hold the box die 350 of the internal box plunger 330. In some aspects, the center portion of the scoring die 324 releasably retains at least a portion of the box die 350 such that both the box die 350 and the scoring die 324 may be manipulated simultaneously.

In further aspects, the internal box plunger 330 may be releasably coupled to the scoring plunger 322, as shown in FIG. 15, which provides an expanded view of bottom portions of the scoring plunger 322 and the internal box plunger 330. The coupling mechanisms shown may also provide a plunger adjustment mechanism for the box making apparatus 300 in accordance with embodiments. Accordingly, the internal box plunger 330 may be dispensed in a downward direction without a surrounding portion of the scoring plunger 322 when disengaged from one or more coupling mechanisms associated with the scoring plunger 322 and/or internal box plunger 330. Similarly, based on manipulation of one or more coupling mechanisms associated of the box-making apparatus 300, the internal box plunger 330 may be configured to travel in a downward direction with the scoring plunger 322, with at least a portion of the internal box plunger 322 nested within at least a portion of the scoring plunger 322, according to some embodiments.

As illustrated, the internal box plunger 330 may be received within a scoring channel 325 of the scoring plunger 322. In some aspects, the scoring plunger 322 includes a bottom wall 334 between the top portion and the scoring die 324 of the scoring plunger 322. The bottom wall 334 may include a center opening 336 and one or more holding structures 338 on opposing sides of the center opening 336. In the embodiment depicted in FIG. 15, the center opening 336 comprises an oval shape, but it is contemplated that the center opening 336 make comprise other shapes including a triangular or rectangle. In some embodiments, the holding structures 338 are positioned along the long sides of the oval shaped, center opening 336. The bottom wall 334 of the scoring plunger 322 may also include one or more rib structures 345 that connect this bottom portion of the scoring plunger 322 to the top portion. As such, one or more features extending from the bottom wall 334 may correspond to one or more features of the housing 320 and/or scoring plunger top portion, for selectively manipulating the scoring plunger 322 with respect to the internal box plunger 330.

The internal box plunger 330 may include a shaft 332. The shaft 332 is partially removed in FIG. 15 to not obscure other features, but in some aspects, the shaft 332 runs along the longitudinal axis 323 through the scoring channel 325. The shaft 332 may be attached to a latch 333, which may be, in turn, attached to the box die 350 (shown in FIG. 20). The latch 333 may comprise a shape corresponding to the center opening 336 of the bottom wall 334 such that the latch 333 may be received through the center opening 336. For instance, the latch 333 may comprise an oval shape.

The scoring plunger 322 may be rotatable around the longitudinal axis 323 and with respect to the internal box plunger 330. The rotation of the scoring plunger 322 may create different arrangements of the latch 333, the holding structures 338, and the center opening 336 such that the scoring plunger 322 may be uncoupled from the internal box plunger 330. For example, in the coupled position, the latch 333 may be received by the holding structures 338 of the bottom wall 334 of the scoring plunger 322. Specifically, the holding structures 338 may each include a top wall 340 and a side wall 342. Together with the bottom wall 334, the top wall 340, and side wall 342 form a channel 339 for receiving a portion of the latch 333, according to some embodiments.

In one aspect, the latch 333 may comprise two, opposing end portions 344 that each may slide within the channel 339 of a holding structure 338. When received into the channel 339, the end portions 344 are each positioned between the top wall 340 and side wall 342 of a holding structure 338. Accordingly, in this coupled position, the internal box plunger 330 cannot move independently of the scoring die 324 of the scoring plunger 322. In other words, when coupled together via the latch 333 and the holding structure 338, a user may depress both the internal box plunger 330 and the scoring die 324 at the same time with a single compression of the plunger handle 326, as discussed below.

Turning back to FIGS. 13-14, the internal box plunger 330 may extend through a top opening of housing 320 towards a plunger handle 326. In some embodiments, the plunger handle 326 comprises a low-profile cylinder, but in other embodiment, the plunger handle 326 comprises different shapes, including a cross shape or a wheel with spokes. As such, the plunger handle 326 may be any shape configured to receive force applied by a user and transfer such force to the corresponding internal box plunger 330 structure. The plunger handle 326 may be coupled to the shaft 332 of the internal box plunger 330 and may be configured to move the internal box plunger 330 along longitudinal axis 323. In some embodiments, the scoring plunger 322 is coupled to the internal box plunger 330, as shown in FIG. 15, such that movement of the plunger handle 326 also results in movement of the scoring plunger 322 via the internal box plunger 330. In some aspects, the plunger handle 326 may be used to manipulate the scoring die 324 and the box die 350 during synchronized travel in an upward and downward direction for imprinting one or more scored markings and/or folds onto the substrate blank 200. Further, the plunger handle 326 may also be used to manipulate the box die 350, without the scoring die 324, for singular travel in an upward and downward direction for generating one or more folds in the substrate blank 200, with the scoring die 324 retained in an upright position.

Additionally, a portion of the internal box plunger 330 may be surrounded by a plunger cover 328 so that only the plunger cover 328, not the internal box plunger 330, is visible between the housing 320 and plunger handle 326. The plunger cover 328 may comprise an accordion-like structure. In accordance with some embodiments, the plunger cover 328 may be received within an opening on the top side of the housing 320 as the internal box plunger 330 is moved up and down along longitudinal axis 323. In other embodiments, the plunger cover 328 folds onto itself, like an accordion, as it is compressed between the housing 320 and the plunger handle 326 when the internal box plunger 330 is depressed.

Figure 16:
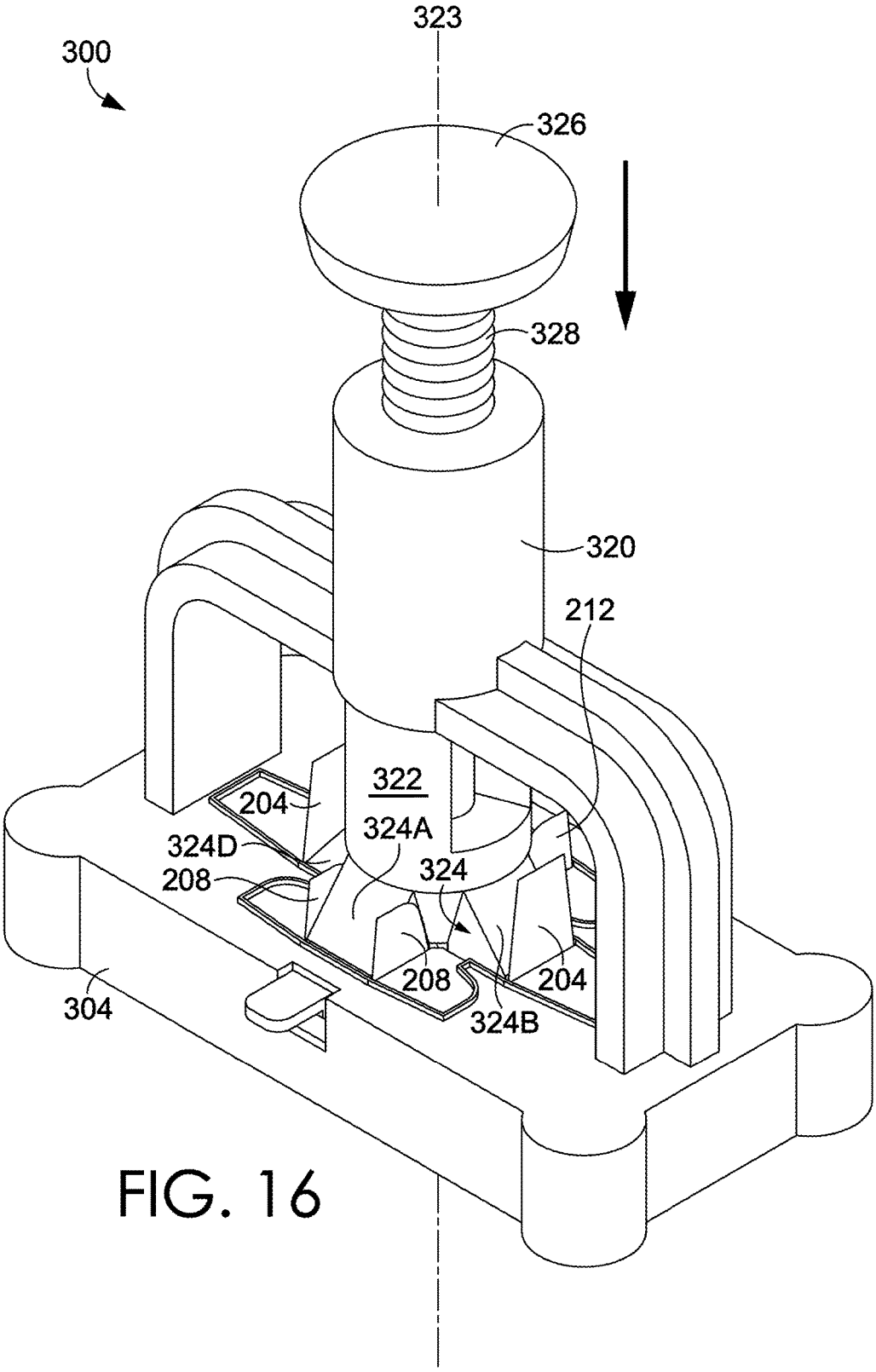
FIG. 16 is a perspective view of the box making apparatus of FIG. 13 in a first depressed position, in accordance with an embodiment of the invention.
Figure 17:
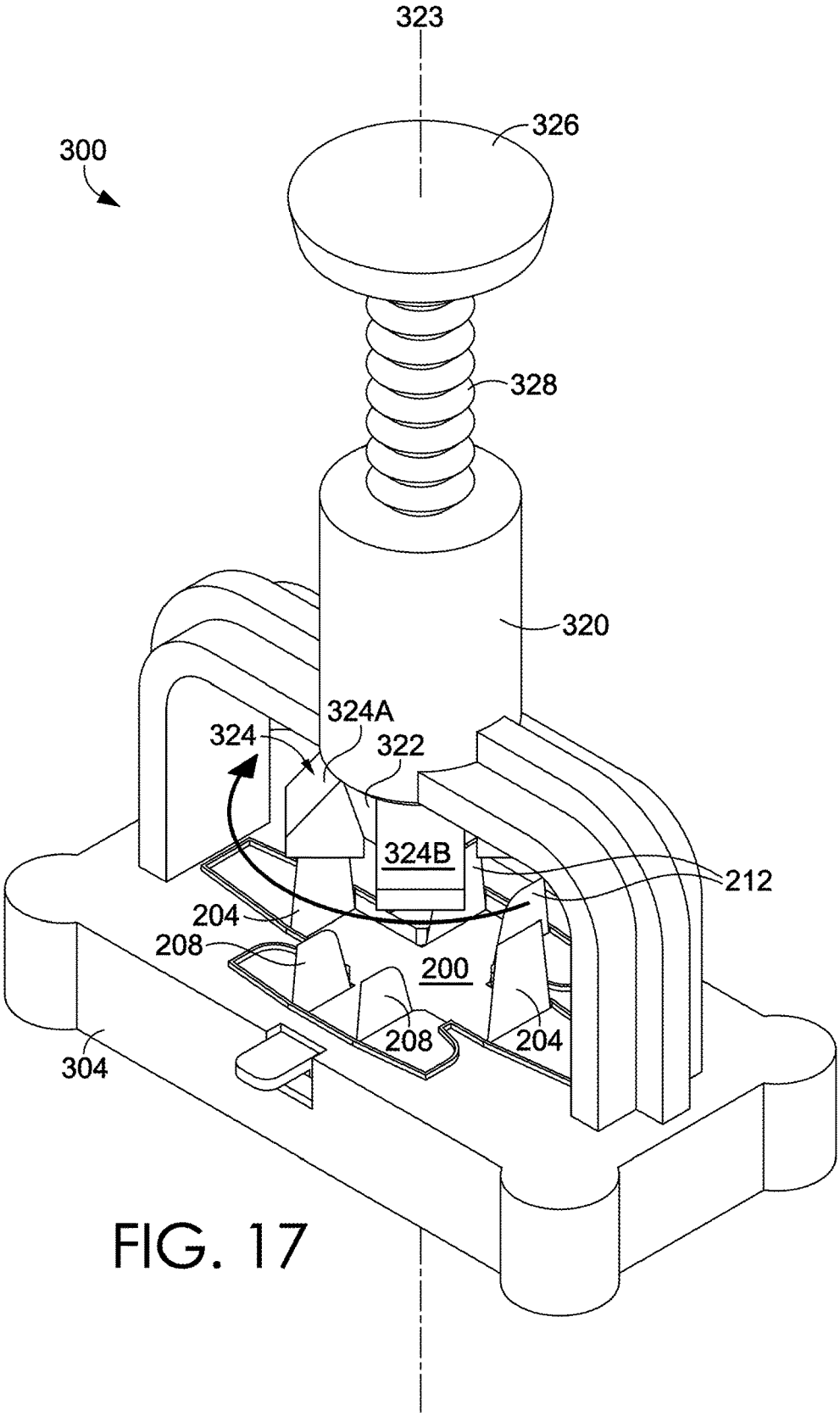
FIG. 17 is a perspective view of the box making apparatus of FIG. 13, in accordance with an embodiment of the invention.

As previously described, a substrate blank 200 may be folded during multiple folding cycles through contact with the scoring die 324 and box die 350, which are moved along the longitudinal axis 323 via their respective plungers. FIG. 16 depicts the box making apparatus 300 during the first fold cycle. Here, the plunger handle 326 may be moved downward relative to the housing 320, causing the shaft 332 of the internal box plunger 330 to also travel downward. Movement of the shaft 332 further causes movement of the box die 350 and the scoring die 324 downward relative to the substrate blank 200 and the base 304.

When the latch 333 is in the coupled position to couple the internal box plunger 330 and the scoring plunger 322 as shown in FIG. 15, the scoring die 324 of the scoring plunger 322 also travels downward relative to the substrate blank 200 and the base 304, in some embodiments. The scoring die 324 and the box die 350 may engage with the die area 306 of the base 304 and contact the substrate blank 200 to form the first set of folds in the substrate blank 200, in the same manner discussed with respect to FIGS. 5A-5E. Specifically, the first set of folds are created when the front prong 324A of the scoring die 324 engages with the front shelf 312A within the die area 306, the right prong 324B engages with the right shelf 312B, the back prong 324C engaged with the back shelf 312C, and the left prong 324D engages with the left shelf 312D. In one aspect, as the plunger handle 326 is released, a spring or tension mechanism, such as springs 108 and 110, provide tension to propel the internal box plunger 330, along with the scoring plunger 322, to the original, elevated position, as shown in FIG. 14. In some aspects, an amount of tension provided to propel the internal box plunger 330 corresponds to an amount of compression of the springs 108 and 110.

Figure 18:
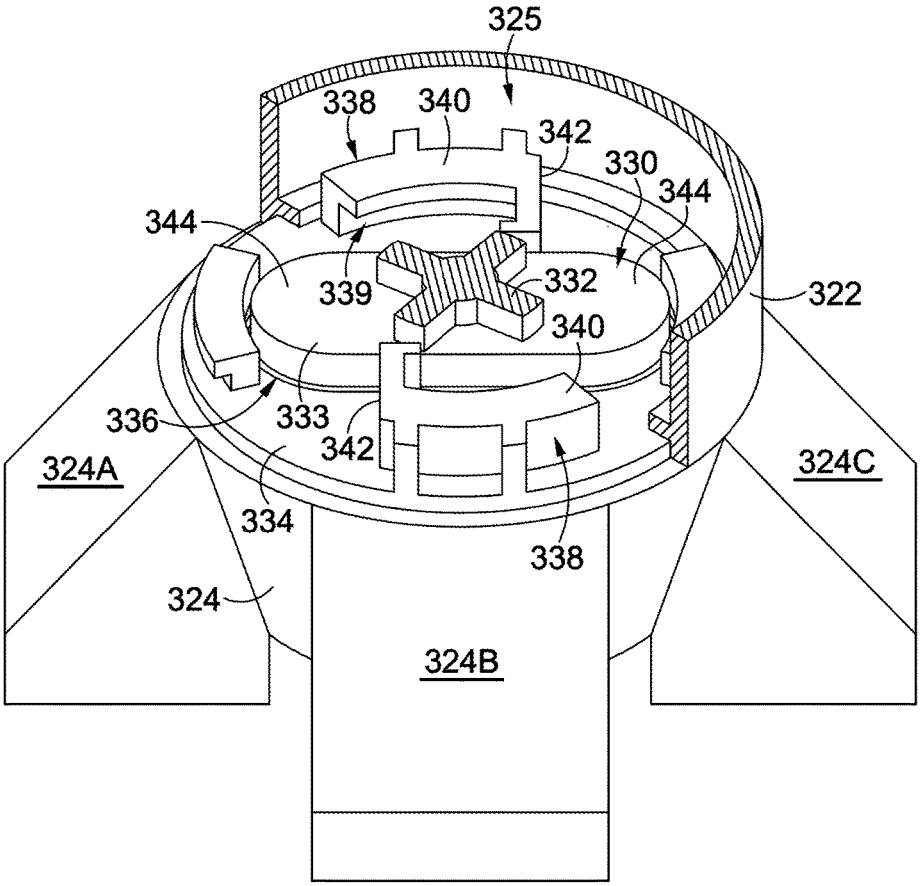
FIG. 18 is an enlarged, perspective view of the plunger adjustment mechanism of the box making apparatus of FIG. 13 with portions removed, in accordance with an embodiment of the invention.

In some embodiments, to shift and/or adjust the plungers for moving between the first cycle position to the second cycle position, the scoring plunger 322 may be rotated with respect to the longitudinal axis 323. This rotation may be done by a user rotating the scoring die 324. In some aspects, rotation of the scoring plunger 322 results in rotation of the center opening 336 within the bottom wall 334 of the scoring plunger 322 with respect to the latch 333. As the scoring plunger 322 rotates, the end portions 344 of the latch 333 slide out from within the holding structures 338 until the perimeter of the latch 333 is aligned with the center opening 336, as shown in FIG. 18. In some embodiments, the scoring plunger 322 is rotated approximately between 20 to 45 degrees to move from the coupled position to the uncoupled position. The side walls 342 of the holding structures 338 may extend towards the center opening 336 so that an outer surface of the side walls 342 contact the latch 333 to prevent over-rotation of the scoring plunger 322, according to some embodiments. In this position, the internal box plunger 330 is no longer coupled to the scoring plunger 322 so that the internal box plunger 330 may be moved independently of the scoring plunger 322.

Once uncoupled, the second folding cycle may begin, as shown in FIGS. 19-20. As the plunger handle 326 is pushed downward, the internal box plunger 330 may travel downwards with respect to the base 304 while the scoring plunger 322 remains stationary and in the elevated position relative to the base 304. Because the rotation of the scoring die 324 aligned the latch 333 with the center opening 336, the latch 333 and the shaft 332 of the internal box plunger 330 may be pushed through the center opening 336 so that the box die 350 is below the scoring die 324 instead of being within the center position of the scoring die 324. In other words, the orientation of features for the second folding cycle includes retention of the scoring die 324 in an upright position, while permitting travel of one or more features including the internal box plunger 330.

During the second fold cycle, the box die 350 may be received within the depression 308 of the die area 306 and cause the substrate blank 200 to form the second set of folds, in the same manner discussed with respect to FIGS. 6A-6E. In one aspect, as the plunger handle 326 is released, a spring or tension mechanism, such as springs 108 and 110, provide tension to propel the internal box plunger 330 to the original, elevated position, as shown in FIG. 14. Accordingly, in some embodiments, at least one fold created during the first cycle provides a pre-folded substrate for further manipulation during the second fold cycle, and any subsequent fold cycles.

Figure 21:
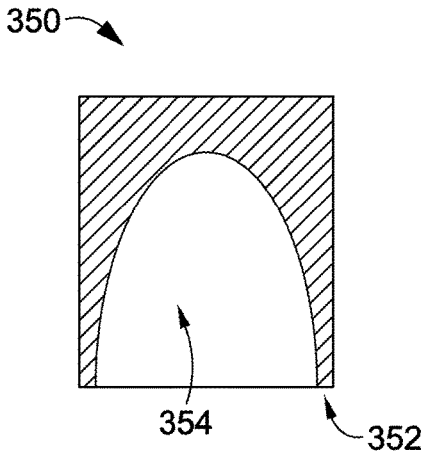
FIG. 21 is a cross-sectional view of the box die taken from reference line 21 in FIG. 20, in accordance with an embodiment of the invention.
Figure 22:
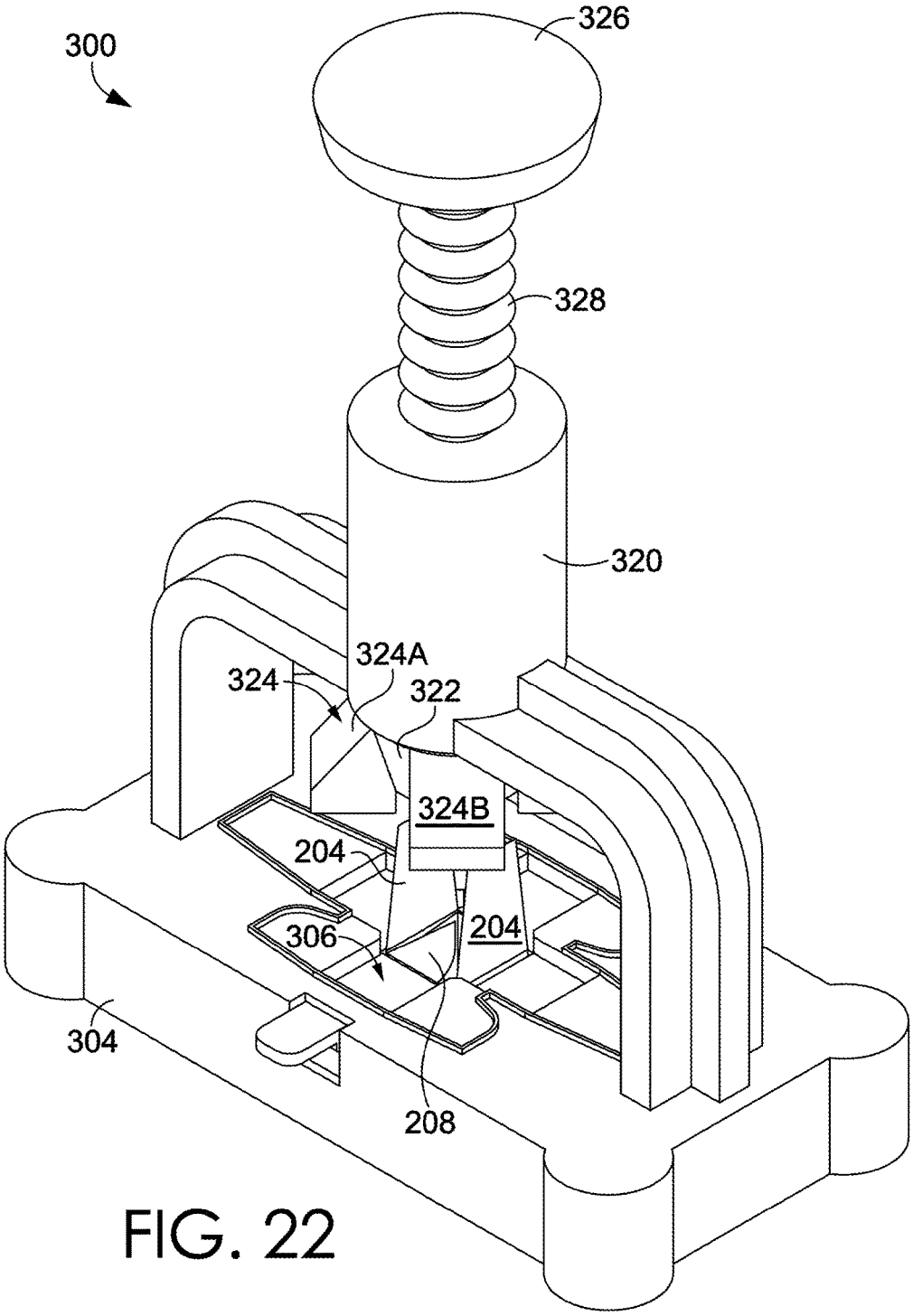
FIG. 22 is a perspective view of the box making apparatus of FIG. 13, in accordance with an embodiment of the invention.

FIG. 21 provides a cross-sectional view of the box die 350 taken at reference line 21 in FIG. 20. The box die 350 may be open on its bottom side 352 to provide access to a cavity 354 within the box die 350. In some embodiments, the cavity 354 has a rounded conical shape. As the box die 350 contacts the substrate blank 200 and is received within the depression 308 of the die area 306, portions of the substrate blank 200 may be received within the cavity 354. For example, as previously mentioned, the second set of folds may include the first outer extensions 208 and the second outer extensions 212 of the substrate blank 200 being brought together within the interior of the box structure so that they overlap. In some embodiments, this movement is caused by the first outer extensions 208 and the second outer extensions 212 being received within the cavity 354 of the box die 350 and being forced to move together to overlap one another by virtue of the rounded shape of the cavity 354. FIG. 22 depicts the box making apparatus 300 after the second folding cycle when the substrate blank 208 is partially folded into a box that is positioned within the depression 308.

Figure 23:
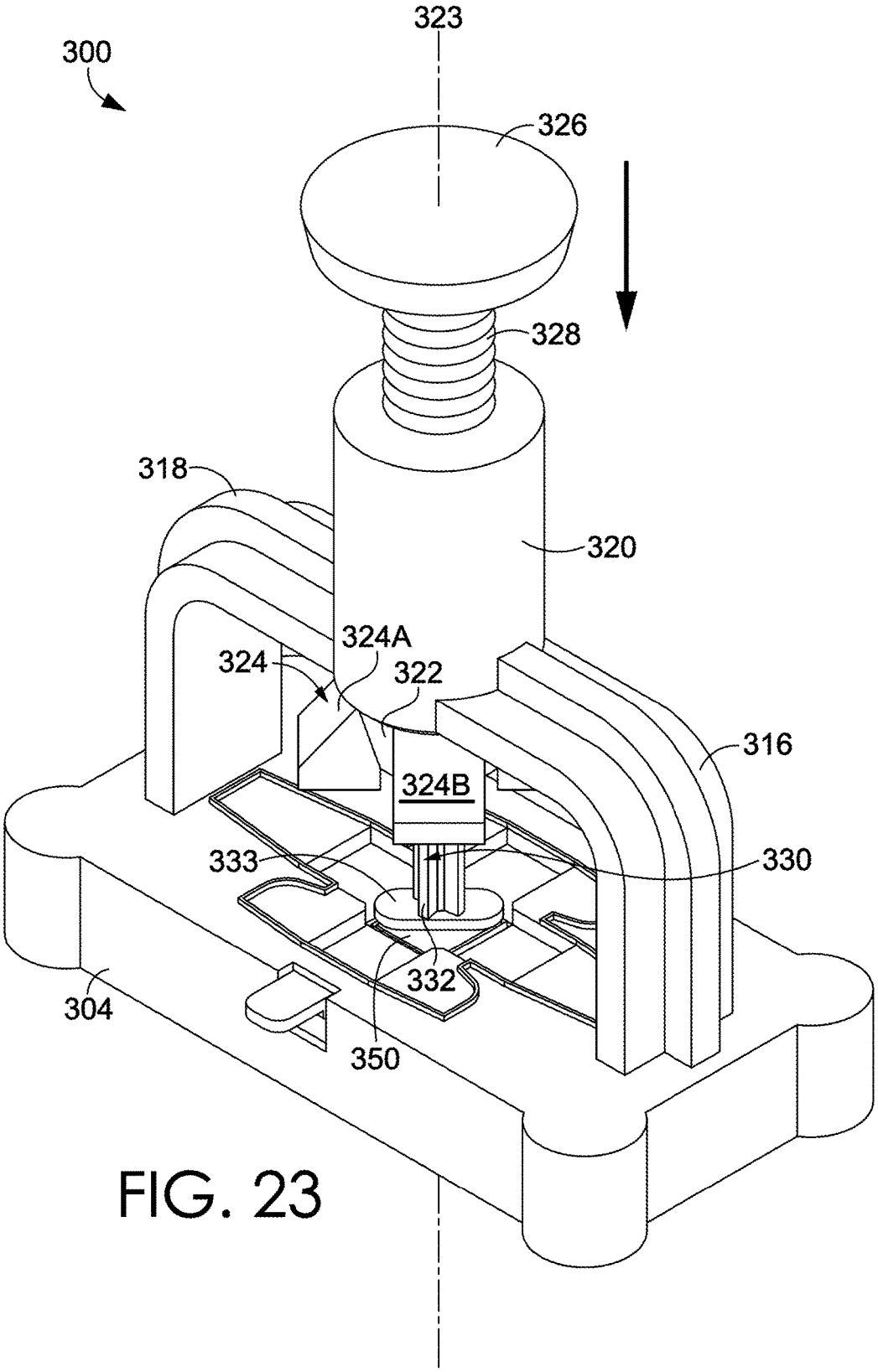
FIG. 23 is a perspective view of the box making apparatus of FIG. 13 in a third depressed position, in accordance with an embodiment of the invention.

While still retaining the scoring plunger 322 in an upright position and permitting travel of the internal box plunger 330, embodiments of the box-making apparatus 300 are configured for performing a third fold cycle, with the resulting impact on the folded substrate blank 200 being different than (i.e., building upon) the manipulation caused by the second fold cycle. FIG. 23 illustrates the box making apparatus 300 during the third fold cycle, according to one aspect. In this cycle, the internal box plunger 330 may remain uncoupled to the scoring plunger 322 such that, as the plunger handle 326 is pushed downwards, the internal box plunger, and the box die 350 is moved downwards while the scoring plunger 322 remains stationary. In this way, the box making apparatus 300 utilizes the same downward and upward movements for the second folding cycle and the third folding cycle.

Figure 24:
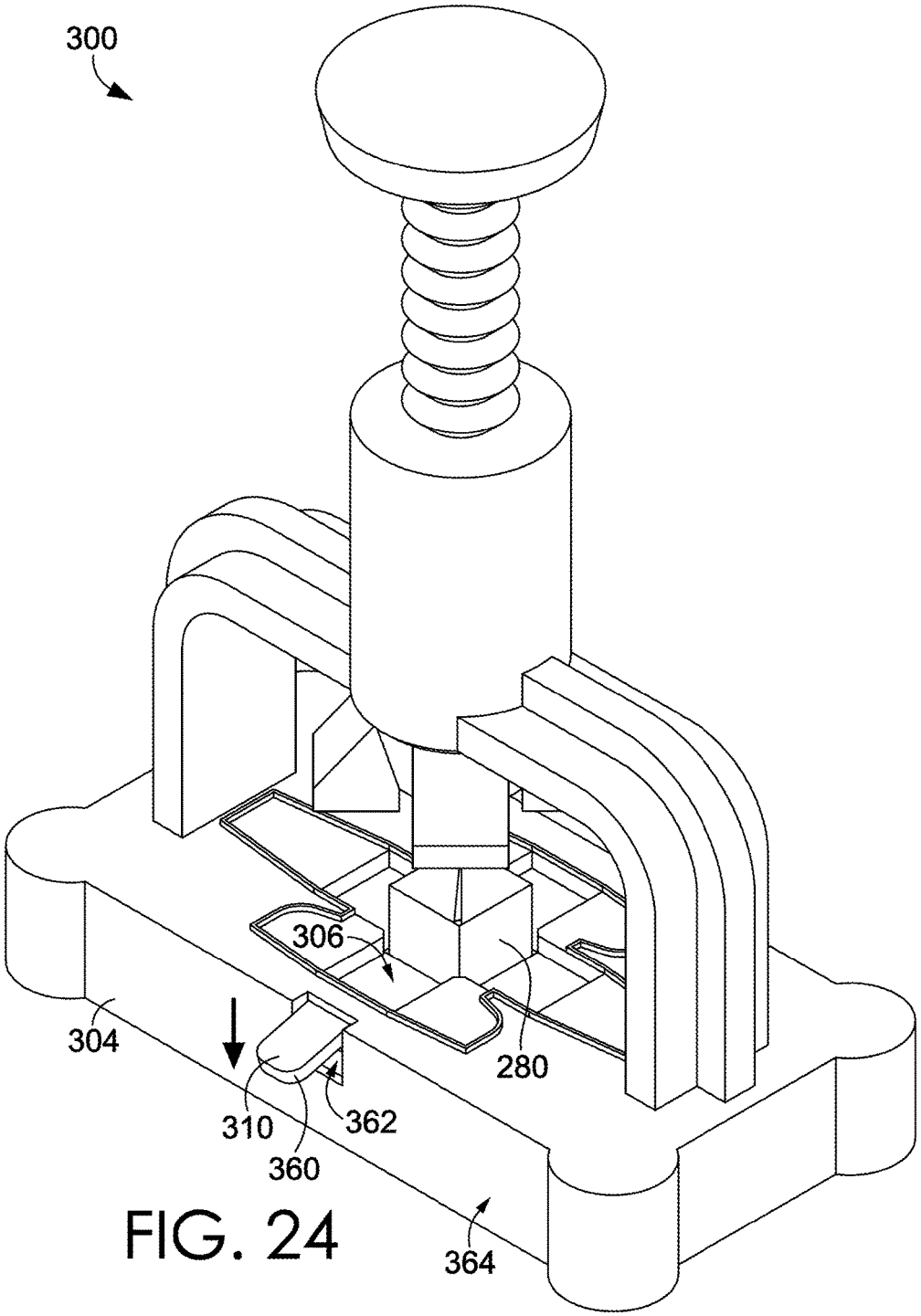
FIG. 24 is a perspective view of the box making apparatus of FIG. 13, in accordance with an embodiment of the invention.

During the third fold cycle, when the box die 350 now comes into contact with the substrate blank 200 again, a third set of folds are made in a similar manner as described with respect to FIGS. 7A-7E. Specifically, the central portion extensions 204 of the substrate blank 200 are folded down into the interior of the box formed by the substrate blank 200. The rounded cavity 354 of the box die 350 may cause this movement of the central portion extensions 204. In one aspect, as the plunger handle 326 is released, a spring or tension mechanism, such as springs 108 and 110, provide tension to propel the internal box plunger 330 to the original, elevated position, as shown in FIG. 24.

The newly-formed box 280 may be positioned within the depression 308 of the die area 306. In some embodiments, the release lever 310 may be used to remove the box 280 from the depression 308. A lifting arm (not visible) of the release lever 310 may form a bottom surface of the depression 308 such that the lifting arm is underneath the box 280 after it is formed. The release lever 310 may also include a release arm 360 that extends through a slot 362 in a front side wall 364 of the base 304. In some aspects, pushing down on the release arm 360 causes the lifting arm to be moved upwards relative to the housing 320, thereby lifting the box 280 upward and out of the depression 308.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. An apparatus for forming pliable substrates into boxes, the apparatus comprising:

a base having a die area and a depression within the die area;

a housing coupled to the base, the housing having an internal channel extending through a longitudinal axis of the apparatus;

a scoring plunger having a top portion configured to slide longitudinally within the internal channel of the housing and a bottom portion comprising a scoring die, wherein the scoring plunger comprises a scoring channel extending through the longitudinal axis of the apparatus;

an internal box plunger having a top portion configured to slide longitudinally within the scoring channel of the scoring plunger and a bottom portion comprising a box die; and a handle configured to travel along the longitudinal axis of the apparatus and to engage at least one of the scoring plunger and the internal box plunger, wherein depressing the handle a first time moves the scoring plunger and the internal box plunger downward relative to the base into a first depressed position, the first depressed position comprising engaging at least the scoring die with the die area to create a first set of folds in a substrate blank positioned within the die area, and wherein depressing the handle a second time moves the internal box plunger downward relative to the base into a second depressed position while the scoring plunger remains stationary, wherein the second depressed position comprises engaging the box die of the internal box plunger with the depression of the die area to create a second set of folds in the substrate blank.

2. The apparatus of claim 1, wherein depressing the handle a third time moves the internal box plunger downward relative to the base into a third depressed position while the scoring plunger remains stationary, wherein the third depressed position comprises engaging the box die of the internal box plunger with the depression of the die area to create a third set of folds to complete a box.

3. The apparatus of claim 1, wherein the die area extends into at least a portion of a front portion, a left portion, a right portion, and a back portion of the base at right angles.

4. The apparatus of claim 1, wherein the scoring die of the scoring plunger is cross-shaped and configured to engage at least a portion of the die area of the base.

5. The apparatus of claim 1, wherein the box die of the internal box plunger is rectangular in shape and configured to engage the depression of the die area.

6. The apparatus of claim 1, wherein the substrate blank comprises a central portion positioned between a first outer portion and a second outer portion, wherein the central portion has central portion extensions extending in opposite directions that are longer than outer portion extensions extending from the first outer portion and the second outer portion, wherein the outer portion extensions are parallel to the central portion extensions.

7. The apparatus of claim 6, wherein the first set of folds creates at least six folds in the substrate blank to generally form a cross shape in which the central portion extensions are bent at a right angle with respect to the central portion and the outer portion extensions are bent at a right angle with respect to the first outer portion and the second outer portion.

8. The apparatus of claim 7, wherein the second set of folds creates at least four folds in the substrate blank such that four prongs of the cross shape created by the first set of folds are bent at a right angle and the outer portion extensions of the first outer portion overlap with the outer portion extensions of the second outer portion.

9. The apparatus of claim 6, wherein depression of the handle a third time creates a third set of folds on the substrate blank, the third set of folds presses the central portion extensions of the central portion down into a partially-formed box to create a box having an open top.

10. The apparatus of claim 1, further comprising one or more springs connecting the handle to one or more remote portions of the apparatus such that tension is applied to move the handle away from the base after the handle is depressed a first time and a second time.

11. An apparatus for forming flat substrates into multi-dimensional shapes, the apparatus comprising:

a base having a die area and a depression within the die area;

a housing coupled to the base, the housing having an internal channel extending through a longitudinal axis of the apparatus;

a scoring plunger having a top portion configured to slide longitudinally into the internal channel of the housing and a bottom portion that comprises a scoring die, wherein the scoring plunger comprises a scoring channel extending through the longitudinal axis of the apparatus;

an internal box plunger having a top portion configured to slide longitudinally into the scoring channel of the scoring plunger and a bottom portion comprising a box die;

a handle having a first guide slot and a second guide slot, wherein the handle engages at least a portion of the housing such that the handle travels along the longitudinal axis of the apparatus, and wherein the first guide slot and the second guide slot are perpendicular to the longitudinal axis of the apparatus and are oriented parallel to one another;

a front outer housing plate attached to the housing and having a first cam path;

a back outer housing plate attached to the housing and having a second cam path; and a plunger rod having a first end that extends through the first guide slot and engages the first cam path of the front outer housing plate, and a second end that extends through the second guide slot and engages the second cam path of the back outer housing plate, wherein the plunger rod travels back and forth along a path perpendicular to the first guide slot and the second guide slot.

12. The apparatus of claim 11, wherein the first cam path is a mirror image of the second cam path and wherein each of the first cam path and the second cam path include a home position, a first cycle fold position, a second cycle fold position, and a third cycle fold position.

13. The apparatus of claim 12, wherein depression of the handle a first time causes the plunger rod to travel along the first cam path and the second cam path to the first cycle fold position and engages the scoring plunger to move at least the scoring plunger downward relative to the base.

14. The apparatus of claim 12, wherein depression of the handle a second time causes the plunger rod to travel along the first cam path and the second cam path to the second cycle fold position and engages the internal box plunger to move only the internal box plunger downward relative to the base.

15. The apparatus of claim 11 further comprising a release drawer configured to be removeably inserted into the base and comprising a rectangular well configured to receive a box being formed.

* * * * *